US011103751B2

(12) United States Patent
Miller et al.

(10) Patent No.: US 11,103,751 B2
(45) Date of Patent: Aug. 31, 2021

(54) COMPUTERIZED EXERCISE APPARATUS

(71) Applicant: Proteus Motion Inc., Long Island City, NY (US)

(72) Inventors: Samuel Adam Miller, Long Island City, NY (US); Anthony Alexander Kolodzinski, Massapequa Park, NY (US); George J. Davies, Savannah, GA (US)

(73) Assignee: PROTEUS MOTION INC., Brooklyn, NY (US)

( * ) Notice: Subject to any disclaimer, the term of this patent is extended or adjusted under 35 U.S.C. 154(b) by 5 days.

(21) Appl. No.: 16/183,179

(22) Filed: Nov. 7, 2018

(65) Prior Publication Data

US 2019/0209892 A1 Jul. 11, 2019

Related U.S. Application Data

(63) Continuation of application No. 15/828,029, filed on Nov. 30, 2017, now Pat. No. 10,159,871, which is a (Continued)

(51) Int. Cl.
*A63B 24/00* (2006.01)
*A63B 21/005* (2006.01)

(Continued)

(52) U.S. Cl.
CPC ..... *A63B 24/0087* (2013.01); *A63B 21/0058* (2013.01); *A63B 21/00178* (2013.01);

(Continued)

(58) Field of Classification Search
CPC ..... A63B 24/0087; A63B 69/0002; A63B 69/36; A63B 69/3641; A63B 69/38;

(Continued)

(56) References Cited

U.S. PATENT DOCUMENTS 4,577,862 A 3/1986 Sagedahl
4,846,466 A * 7/1989 Stima, III ..... A63B 23/03516 482/112

(Continued)

FOREIGN PATENT DOCUMENTS

JP 2002/127058 5/2002
JP 2007/520311 7/2007

(Continued)

OTHER PUBLICATIONS

International Preliminary Report on Patentability for International Application No. PCT/US2017/034191, entitled: "Computerized Exercise Apparatus," dated Jan. 3, 2019 (11 pgs).

(Continued)

*Primary Examiner* — Sundhara M Ganesan
(74) *Attorney, Agent, or Firm* — Hamilton, Brook, Smith & Reynolds, P.C.

(57) ABSTRACT

A training, rehabilitation, and recovery system comprises an exercise apparatus including a user interface member coupled to a plurality of links and joints, brakes capable of resisting movement of at least a subset of the links or joints, and sensors capable of sensing movement at the joints or the user interface member. The system also includes a processor configured to receive from the sensors positional data of the links or joints over an initial movement of the apparatus by a user, from which positional coordinates of the user interface member are calculated and a reference trajectory is established. An end space is defined based on the reference trajectory. Over a subsequent movement of the apparatus by the user, the processor receives additional positional data and determines a completion of a repetition based on the positional coordinates of the subsequent movement and the defined end space.

16 Claims, 32 Drawing Sheets

Related U.S. Application Data continuation of application No. 15/409,084, filed on Jan. 18, 2017, now Pat. No. 9,861,856.

(60) Provisional application No. 62/353,870, filed on Jun. 23, 2016, provisional application No. 62/352,877, filed on Jun. 21, 2016.

(51) Int. Cl.

| | |
|---|---|
| ***A63B 21/00*** | (2006.01) |
| ***A63B 69/00*** | (2006.01) |
| ***A63B 69/36*** | (2006.01) |
| ***A63B 69/38*** | (2006.01) |
| *A63B 71/06* | (2006.01) |
| *A63B 21/008* | (2006.01) |
| *A63B 21/02* | (2006.01) |
| *A63B 21/055* | (2006.01) |
| *A63B 21/072* | (2006.01) |

(52) U.S. Cl.

CPC ..... *A63B 21/4035* (2015.10); *A63B 21/4047* (2015.10); *A63B 24/0006* (2013.01); *A63B 24/0075* (2013.01); *A63B 69/0002* (2013.01); *A63B 69/36* (2013.01); *A63B 69/3621* (2020.08); *A63B 69/38* (2013.01); *A63B 21/005* (2013.01); *A63B 21/008* (2013.01); *A63B 21/0085* (2013.01); *A63B 21/00181* (2013.01); *A63B 21/02* (2013.01); *A63B 21/023* (2013.01); *A63B 21/0552* (2013.01); *A63B 21/072* (2013.01); *A63B 71/0622* (2013.01); *A63B 2024/0012* (2013.01); *A63B 2024/0093* (2013.01); *A63B 2069/0004* (2013.01); *A63B 2069/0006* (2013.01); *A63B 2071/0625* (2013.01); *A63B 2071/0655* (2013.01); *A63B 2220/10* (2013.01); *A63B 2220/17* (2013.01); *A63B 2220/20* (2013.01); *A63B 2220/30* (2013.01); *A63B 2220/40* (2013.01); *A63B 2220/51* (2013.01); *A63B 2220/70* (2013.01); *A63B 2220/76* (2013.01); *A63B 2220/801* (2013.01); *A63B 2220/803* (2013.01); *A63B 2220/805* (2013.01); *A63B 2220/807* (2013.01); *A63B 2225/093* (2013.01); *A63B 2225/20* (2013.01); *A63B 2225/50* (2013.01); *A63B 2230/06* (2013.01); *A63B 2230/75* (2013.01)

(58) Field of Classification Search

CPC ..... A63B 21/0058; A63B 24/0075; A63B 21/00178; A63B 21/4035; A63B 21/4047; A63B 21/02; A63B 24/0006; A63B 71/0622; A63B 21/005; A63B 21/008; A63B 21/0085; A63B 21/023; A63B 21/0552; A63B 21/072; A63B 2069/0004; A63B 2069/0006; A63B 2071/0625; A63B 2071/0655; A63B 2220/10; A63B 2220/17; A63B 2220/20; A63B 2220/51; A63B 2220/70; A63B 2220/76; A63B 2220/801; A63B 2220/803; A63B 2220/805; A63B 2220/807; A63B 2225/093; A63B 2225/50; A63B 2230/06; A63B 2230/75; A63B 21/00181; A63B 2024/0012; A63B 2024/0093; A63B 2220/30; A63B 2220/40; A63B 2225/20

See application file for complete search history.

(56) References Cited

U.S. PATENT DOCUMENTS

| | | | | |
|---|---|---|---|---|
| 5,466,213 | A | 11/1995 | Hogan et al. | |
| 5,755,645 | A | 5/1998 | Miller et al. | |
| 6,185,451 | B1 | 2/2001 | Richardson et al. | |
| 7,837,599 | B2 | 11/2010 | Kowalczewski et al. | |
| 8,177,732 | B2 | 5/2012 | Einav et al. | |
| 8,214,029 | B2 | 7/2012 | Koeneman et al. | |
| 8,540,652 | B2 | 9/2013 | Tong et al. | |
| 8,900,099 | B1 | 12/2014 | Boyette | |
| 9,101,791 | B2 | 8/2015 | Boyette | |
| 9,446,288 | B1 | 9/2016 | Pazan | |
| 9,861,856 | B1 | 1/2018 | Miller et al. | |
| 10,159,871 | B2 | 12/2018 | Miller et al. | |
| 2007/0219059 | A1 | 9/2007 | Schwartz et al. | |
| 2008/0119763 | A1 | 5/2008 | Wiener et al. | |
| 2010/0190617 | A1* | 7/2010 | Gautier | A63B 23/1263 482/94 |
| 2013/0065680 | A1 | 3/2013 | Zavadsky et al. | |
| 2014/0135174 | A1* | 5/2014 | Potash | A63B 23/0494 482/8 |
| 2014/0287876 | A1 | 9/2014 | Etter et al. | |
| 2015/0224365 | A1 | 8/2015 | Birrell | |
| 2016/0136483 | A1 | 5/2016 | Reich et al. | |
| 2016/0346590 | A1* | 12/2016 | Giannelli | A63B 21/063 |
| 2016/0354638 | A1* | 12/2016 | Carr | A63B 24/0087 |
| 2017/0361165 | A1 | 12/2017 | Miller et al. | |
| 2017/0361166 | A1* | 12/2017 | Hong | A63B 21/005 |
| 2018/0193701 | A1 | 7/2018 | Miller et al. | |

FOREIGN PATENT DOCUMENTS

| | | |
|---|---|---|
| WO | WO 2013/168738 | 1/2016 |
| WO | 2017/222729 A1 | 12/2017 |

OTHER PUBLICATIONS

Notification of Transmittal of the International Search Report and the Written Opinion of the International Searching Authority for International Application No. PCT/US2017/034191, entitled: "Computerized Exercise Apparatus," dated Sep. 22, 2017.

* cited by examiner

NON COLLINEAR

COLLINEAR

COMPUTERIZED EXERCISE APPARATUS

RELATED APPLICATION(S)

This application is a continuation application of U.S. application Ser. No. 15/828,029, filed Nov. 30, 2017, which is a continuation of U.S. application Ser. No. 15/409,084, filed Jan. 18, 2017, which claims the benefit of U.S. Provisional Application No. 62/352,877, filed Jun. 21, 2016, and U.S. Provisional Application No. 62/353,870, filed Jun. 23, 2016. The entire teachings of the above applications are incorporated herein by reference.

BACKGROUND

Traditional exercise, sport training, and rehabilitation programs typically require the presence or input of a trainer or physical therapist. Determinations as to, for example, a Maximum Volitional Contraction (MVC) test are made based on the observations of an individual by the trainer or physical therapist as well as exertion as perceived by the user. Other determinations as to the muscular strength of, for example, an athlete, patient, or other person undergoing evaluation, are made based on performance of resistance exercises or other movements restricted to a single plane of motion or movements that involve isolating individual muscles. Once an exercise, training or rehabilitation regimen is prescribed by the trainer or therapist, proper performance of the regimen is dependent upon the individual. Performance of the regimen often occurs without ongoing feedback and support from the trainer or therapist. Otherwise, the provided feedback or support can be imprecise, incomprehensive, ill-informed or irrelevant as to real life (e.g., sport) performance, or largely subjective. There is a need for smart exercise and training devices that can provide virtual and automated personal training, as well as customized and adaptable training and recovery functionality and programs that are tailored to an individual user's specific needs, based at least in part on improved abilities to quantify performance.

SUMMARY OF THE INVENTION

A training and recovery system is provided that comprises an exercise apparatus including a user interface member coupled to a plurality of links and joints, brakes capable of resisting movement of at least a subset of the links or joints, and sensors capable of sensing movement at at least a subset of the joints. The system also includes a processor configured to receive from the sensors positional data of the links or joints over an initial movement of the apparatus by a user. The processor is also configured to calculate positional coordinates of the user interface member from the sensed positional data, thereby establishing a trajectory, and define a beginning and end space based on the reference trajectory. Over a subsequent movement of the apparatus by the user, the processor receives additional positional data, calculates positional coordinates of the user interface member for the subsequent movement, and determines a completion of a repetition based on the positional coordinates of the subsequent movement and the defined end space. The end space can be defined as a three-dimensional space, such as a sphere, or a two-dimensional space, such as a circular area or other shape within a plane. The plurality of links and joints of the exercise apparatus can permit movement in a spherical workspace.

In addition, or alternatively, an exercise apparatus can include at least one sensor capable of sensing movement of the user interface member. A processor can be configured to receive from at least one sensor positional data of the user interface member, from which positional coordinates of the user interface member in a three-dimensional space can be calculated. Additionally, the system processor can be further configured to learn from aggregate data across a user population to adequately recognize trajectory classifications, as well as when a user begins and finishes a repetition.

The processor can be further configured to calculate performance metrics at positional coordinates along the reference trajectory and/or subsequent movements, including velocity and acceleration. Resistance levels of the brakes for subsequent user movements of the apparatus along the reference trajectory can be based on the calculated velocity and/or acceleration. The processor can also be configured to establish a repetition trajectory based on calculated positional coordinates of the subsequent movement and calculate performance metrics along the repetition trajectory.

Invisible hand assistance can be provided to a user for subsequent movements over a desired trajectory, which can be established based on the reference trajectory. For example, the processor can be configured to detect a deviation from the desired trajectory (e.g., a positional coordinate that is not on or close to the reference trajectory, or a velocity that will result in a user deviating from the reference trajectory) and automatically adjust resistance levels of the brakes to guide the user to remain on the trajectory, to return to the trajectory, or even to avoid the trajectory. The adjusted resistance levels can partially oppose a calculated velocity or acceleration of the user's movement, such that a user does not experience a sticky resistance when moving the user interface member of the exercise apparatus.

Locked trajectory assistance can be provided to a user for subsequent movements over a desired trajectory. For example, the processor can be configured to establish resistance levels of the brakes to prohibit movement of at least one link or joint of the apparatus. This can restrict the user to single plane or cardinal plane movements. Alternatively, or in addition, resistance levels of the brakes can be automatically adjusted to provide linearly increasing or decreasing resistance in a direction away from the reference trajectory.

The processor can also be configured to automatically adjust resistance levels of the brakes to provide various types of resistances for subsequent user movements. Collinear resistance can be provided, whereby the user experiences a constant resistance over a desired trajectory, that opposes the direction of a user's movement. Other types of resistances can be simulated, such as elastic resistances and gravitational resistances. The system can also provide for maximum power and/or constant power of the user. In particular, resistance levels of the brakes can be automatically decreased at a point along the trajectory when a low velocity at that point is detected, such that a user is performing at a constant power output. Similarly, resistance levels of the brakes can be automatically increased until a low velocity is detected.

The processor can also communicate with a network-based server and performance data of the user can be stored on the network-based server. A remote user may view the performance data via the network, and, further, may establish resistance levels of the brakes for subsequent repetitions of movements for the user. The processor can be further configured to assess performance of the user relative to the user's own performance history, aggregated data of multiple users on the network-based server, and recognized standards of performance. Additionally, a remote user may establish or adapt entire exercises or training and recovery regimens for the user.

A method of providing training or recovery to a user includes receiving from sensors of an apparatus positional data of the links or joints over an initial movement of the apparatus by the user and calculating positional coordinates of a user interface member of the apparatus from the sensed positional data over the initial movement, thereby establishing a reference trajectory. The method further includes defining an end space based on the reference trajectory, receiving from the sensors positional data of the links over a subsequent movement of the apparatus by the user, calculating positional coordinates of the user interface member from the sensed positional data over the subsequent movement, and determining a completion of a repetition based on the positional coordinates of the subsequent movement and the defined end space.

A non-transitory computer readable medium has an executable program stored thereon, which instructs a processing device to receive from sensors positional data of a plurality of links and joints of an apparatus over an initial movement of the apparatus by the user, the apparatus including a user interface member coupled to the plurality of links and joints, brakes capable of resisting movement of at least a subset of the links or joints, and sensors capable of sensing movement at the joints. The processing device is further instructed to calculate positional coordinates of the user interface member from the sensed positional data over the initial movement, thereby establishing a reference trajectory, and define an end space based on the reference trajectory. The processing device is further instructed to receive from the sensors positional data of the links over a subsequent movement of the apparatus by the user, calculate positional coordinates of the user interface member from the sensed positional data over the subsequent movement, and determine a completion of a repetition based on the positional coordinates of the subsequent movement and the defined end space.

A method of performing a physical assessment includes providing an exercise apparatus, establishing an initial resistance level of the brakes of the apparatus, and prompting a user to perform a number of repetitions of a movement over a desired trajectory with the exercise apparatus at the initial resistance level. Performance metrics for each repetition, based on sensed movement of the joints during the repetition, can be compared. A significant change in performance among the repetitions can be indicative of a user having reached his or her maximum resistance level, or Maximum Volitional Contraction (MVC). Likewise, a lack of change in performance can be indicative of a user not having yet reached his or her maximum resistance level. The user can be prompted to perform any number of repetitions from which a comparison may be drawn (e.g., two or more repetitions, three repetitions, five repetitions, ten repetitions). A change in performance can be, for example, a decrease in power in at least one of the repetitions of the user, deceleration in at least one of the repetitions of the user, and/or deviation from the established trajectory in at least one of the repetitions of the user. Upon detection of a lack of a significant change in user performance, the resistance level of the brakes can be increased and the user can be prompted to perform a subsequent number of repetitions at the increased resistance level. This process can be repeated until a maximum resistance level is determined. Upon detection of a significant change in user performance, subsequent resistance levels can be based on a percentage of the determined maximum resistance level. For example, resistance levels can be set at about 80% (for training) or at about 60% (for recovery) of the detected maximum resistance level. Also, from the performance metrics for each repetition, abnormal consistencies in user performance can be detected. For example, a consistent decrease in power at a point along the trajectory, a consistent deceleration at a point along the trajectory, and/or a consistent deviation in position at a point along the trajectory can be indicative of an injury, weakness, or other deficiency of the user. Comparing performance metrics can include comparing performance metrics of repetitions within a set, across several sets, within a session, across several sessions, or any combination thereof. A comparison of performance metrics can be among data of a single user, to at least one other user, to a standardized metric, or any combination thereof.

Another method of performing a physical assessment includes providing an exercise apparatus and establishing resistance levels of the brakes of the apparatus for a plurality of movements of a performance index or performance profile. The user can be prompted to perform a number of repetitions of each of the plurality of movements, and performance metrics across the movements can be compared. The performance index or performance profile can include at least two functional movements. Alternatively, or in addition, the performance index or profile can include at least one functional movement, at least one joint muscle group movement, and at least one isolated muscle movement.

A group-training system can include two or more exercise systems that are configured to communicate with a network-based server. Performance data based on sensed movement of the joints from each system can be aggregated on the network-based server. The performance data can be viewable by a remote user via the network-based server in real time. Historical performance data can also be viewed. Each exercise system can obtain a personalized training or recovery program from the network-based server.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale; emphasis instead being placed upon illustrating embodiments of the present invention.

DETAILED DESCRIPTION OF THE INVENTION

A description of example embodiments of the invention follows.

A system is provided that can be used for training, exercise, and rehabilitation. The system includes an exercise device that is able to accommodate complex functional motions, such as throwing a ball, swinging a golf club, a manual work related task, or other multi-planar movements such as diagonal Proprioceptive Neuromuscular Facilitation (PNF) patterns. Such systems are advantageous for use in, for example, sports rehabilitation or training settings, where users may already have mobility or volitional control, but are seeking diagnosis, assessment, rehabilitation, and/or training with regard to complex functional motions that cannot be performed on traditional exercise equipment. Systems of the present invention are also configured to provide for the performance of complex motions at high speeds, as well as react in real-time, such as, for example, by dynamically adjusting resistances of the device during a single repetition of an exercise and by providing precise, real-time physical assessment data of the motion.

In traditional exercise and rehabilitation settings, exercise apparatuses are typically provided that restrict motion to one particular movement, to one or two particular planes, or to one particular direction of resistance, and/or work one particular muscle or muscle group. Such apparatuses do not translate well, if at all, to real life activities. Accordingly, the utility of such apparatuses for use in complex sports training/rehabilitation is limited. Furthermore, as such apparatuses provide resistances originating from a fixed direction that may not be relevant to the movement being performed or to training, exercise and rehabilitation goals, any data collected with such apparatuses is also of limited use in assessing a user in terms of, for example, power or other performance metrics.

Systems of the present invention can include exercise apparatuses capable of providing multiple degrees of freedom and dynamic resistances, such that realistic, complex motions can be performed and assessed. Exercise apparatuses can include a user interface member coupled to a plurality of links and joints, brakes capable of resisting movement of at least a subset of the links or joints, and sensors capable of sensing movement at the joints or the user interface member. An example of an exercise apparatus is further described in U.S. Pat. No. 5,755,645, the entire teachings of which are incorporated herein by reference.

Figure 1:
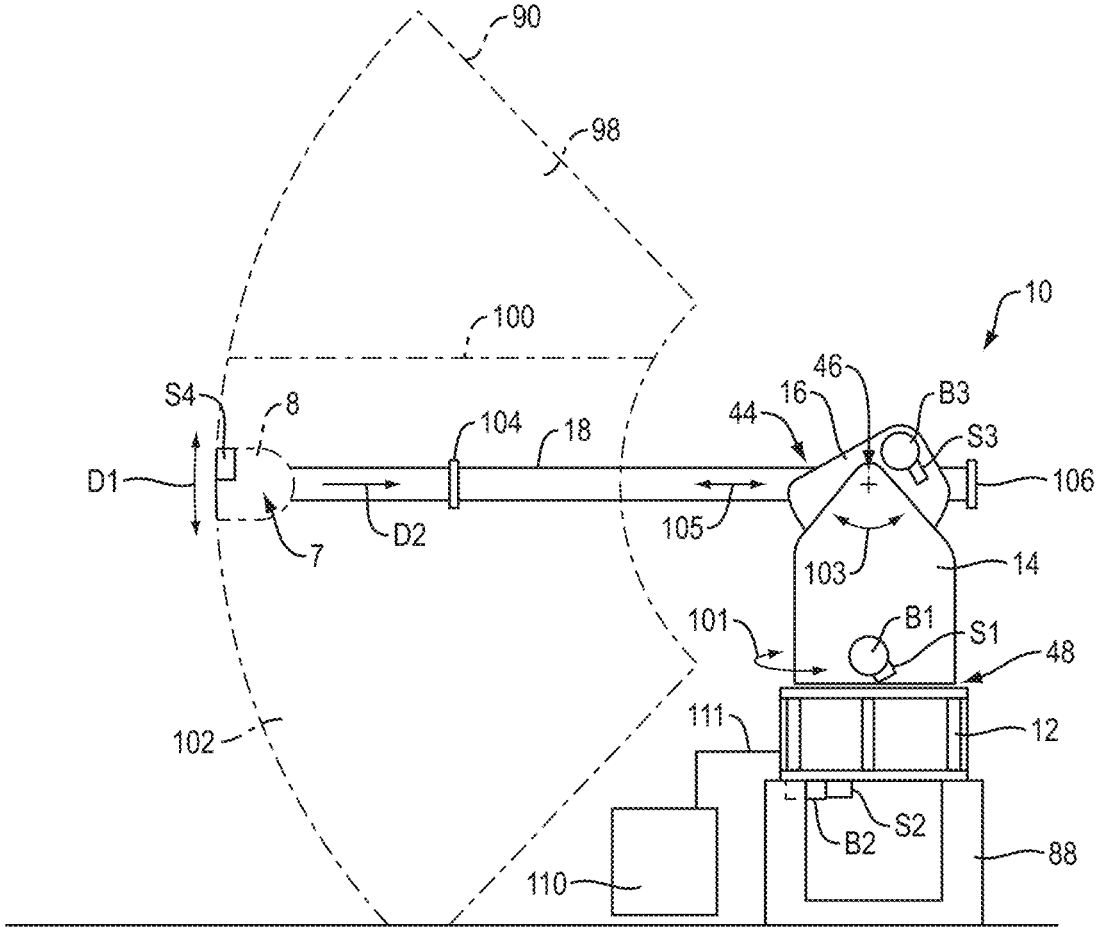
FIG. 1 is a side view of an exercise apparatus.
Figure 2:
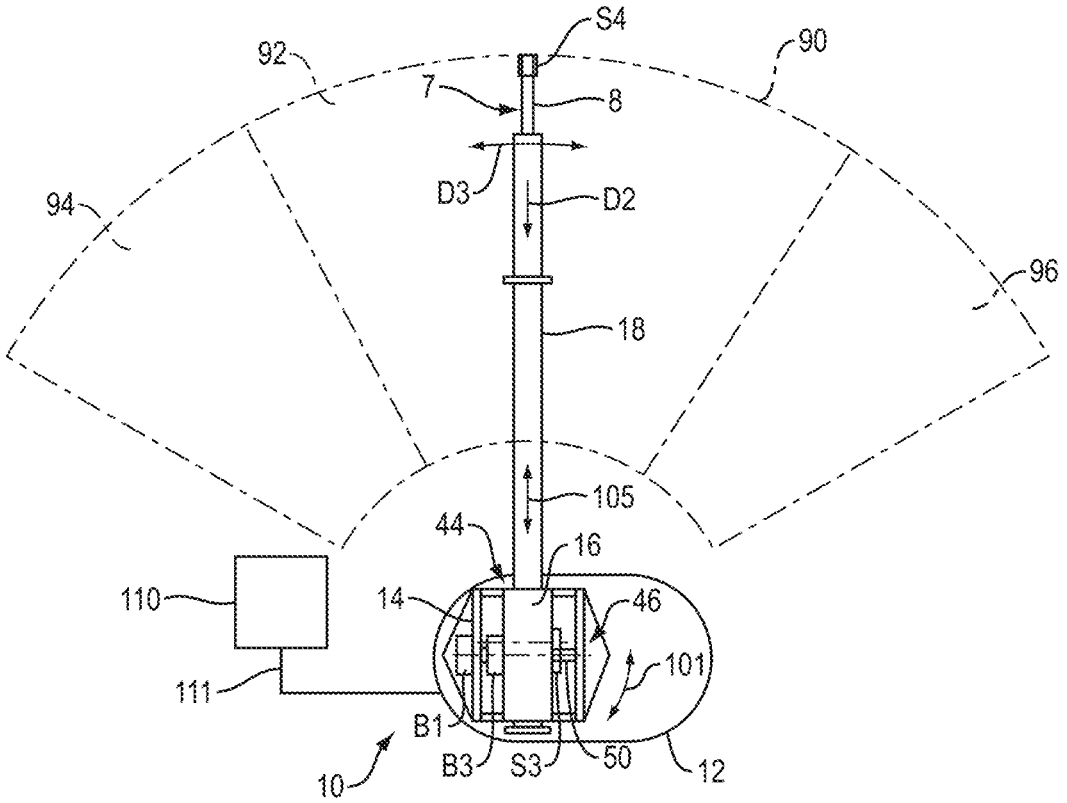
FIG. 2 is a plan view of the exercise apparatus of FIG. 1.

Referring to FIGS. 1 and 2, exercise apparatus 10 includes a limb interface 8 which is coupled to the distal end of a tubular arm member 18 by a wrist joint 7, which can have one, two, or three rotational degrees of freedom. Limb interface 8 has a handle, or other user interface member, which a user grips with his/her hand. Wrist joint 7 can be gimbaled, such that a user's hand can be comfortable oriented at almost any position relative to the apparatus 10. Arm member 18 is coupled to and slides relative to a shoulder member 16 along a linear sliding joint 44. Shoulder member 16 is rotatably coupled to a turret 14 by a rotary shoulder joint 46. Rotary shoulder joint 46 allows arm member 18 and shoulder member 16 to pivot up and down relative to the ground. Turret 14 is rotatably coupled to a base 12 by a rotary waist joint 48. Rotary waist joint allows arm member 18, shoulder member 16, and turret 14 to be swung horizontally relative to the ground. Base 12 is supported by a stand 88 which raises exercise apparatus 10 to a height suitable for use by a user. The limb interfaces can also be attached to the legs, elbows, head and torso of the user. In such cases, appropriate modifications to the limb interface are required. Also, although exercise apparatus 10 is shown to be positioned on a floor stand, alternatively, the present invention exercise apparatus can be suspended upside down or positioned sideways.

Rotational movement of rotary shoulder joint 46 (indicated by arrows 103) is controllably resisted by a brake B1 which is coupled to rotary shoulder joint 46 by a first transmission. Rotational movement of rotary waist joint 48 (indicated by arrows 101) is controllably resisted by a brake B2 which is coupled to rotary waist joint 48 by a second transmission. Linear movement of arm member 18 relative to shoulder member 16 along sliding joint 44 (indicated by arrows 105) is controllably resisted by a brake B3 which is coupled to arm member 18 by a third transmission. Brakes B1, B2 and B3 can be magnetic particle brakes which provide a maximum torque of 17 N-M but, alternatively, can be any mechanism or device that inhibits motion, including, for example, induction or disc brakes, drum brakes, hydraulic brakes, air brakes, rotary actuators, or other braking or resistance mechanisms or devices, such as a motor or stepper motor. The transmissions can reduce the amount of torque that is transmitted to brakes B1, B2 and B3. The transmissions can be cable drive transmissions having low friction and zero backlash, but, alternatively, other transmissions can be employed such as gear trains or belt drives. The amount of resistance provided by brakes B1, B2 and B3 is controlled by a computer 110 which communicates with brakes B1, B2 and B3 by a communication line 111.

During use, the amount of resistance provided by brakes B1, B2 and B3 can be determined, at least in part, by the speed or positions at which joints 44, 46 and 48 move. In one embodiment, the faster joints 44, 46 and 48 move, the greater the resistance brakes B1, B2 and B3 provide. This is known as viscous damping and is an example of a type of resistance that can be provided by device 10. Each joint 44, 46 and 48 can be provided with equal amounts of resistance, or varying amounts of resistance. A series of sensors S1, S2, and S3 indirectly sense the speed at which joints 44, 46 and 48 move by sensing the rotational displacement of brake shafts of respective brakes B1, B2 and B3. Alternatively, or in addition, a sensor S4, located at limb interface 8, can sense linear acceleration and angular velocity of the limb interface 8 whereby position in space of the limb interface 8 is determined. Alternatively, or in addition, a motion capture system consisting of a series of cameras and computer vision software can calculate the position, velocity, and acceleration of the user interface member. This data can then be streamed to Computer 110 in place of, or in addition to, measurements from sensors S1, S2, S3, and S4. Computer 110 uses this information to determine the appropriate amount of resistance that brakes B1, B2 and B3 should provide and then controls the resistance of brakes B1, B2 and B3 appropriately. The sensors S1, S2, S3, and S4 can be optical encoders, but, alternatively, can be other types of sensors, such as potentiometers, resolvers, accelerometers, gyroscopes, inertial measurement units (IMUs), motion capture or computer vision systems, or a combination thereof.

In use, a user grasping limb interface 8 can move limb interface 8 in the directions indicated by arrows D1, D2 and D3 in a spherical configuration anywhere within the three dimensional resistance field 90 to exercise a full functional motion. Although exercise apparatus 10 only has three degrees of freedom which are braked, the user can exercise in six degrees of freedom of motion. By making modifications to limb interface 8, a user can exercise virtually any functional motion. Functional motions can be any movement pattern including activities of daily living, general exercise motions, such as bicep curls, work simulation motions, or motions that are tailored specifically, for example, rowing, swimming, pitching, hitting a baseball or hitting a tennis ball, etc.

Computer 110 can be programmed to provide resistance field 90 with separate areas of varying resistance. In this manner, the user can control the workspace providing resistance where it is desired. For example, in FIG. 1, dividing line 100 divides resistance field 90 into two resistance areas 98 and 102. Resistance area 98 provides a different amount of resistance than resistance area 102. Such an arrangement can be employed to simulate, for example, the waterline for exercising swimming or rowing motions. Referring to FIG. 2, resistance field 90 is divided into three different resistance areas 94, 92 and 96 as an example of another configuration of resistance areas. In other preferred embodiments, resistance areas can be employed to help guide a user through a desired motion or to ensure a user completes, adheres to, complies with, or safely performs a desired motion, for example, a throwing motion. In such a case, one resistance area is shaped to have the path of the throwing motion and has less resistance than the surrounding resistance areas which thus helps passively guide the user along the desired motion. If desired, multiple resistance areas can be employed to simulate actual conditions including but not limited to the simulation of moving in water, mud, wind, vibration, or other natural and unnatural elements and conditions.

Exercise apparatuses can be passive, such as the apparatus described above and in U.S. Pat. No. 5,755,645, such that motion imparted to a portion of the user's body is produced by voluntary effort on the part of the user. Alternatively, exercise apparatuses can include additional elements such as motors to impart or assist motion of a user. Some embodiments can include both braking and motor capabilities to provide passive and active features.

Exercise apparatuses can include additional hardware features. For example, an apparatus can have a telescoping arm (FIGS. 23A-23B) to provide for size reduction and decreased stowage footprint when the device is not in use. The user interface member (e.g., limb interface 8) can include sensors to track grip strength, heart rate, tension, perspiration, or other biometric measurements. The user interface member can also be interchangeable. For example, a forearm brace can be swapped for a handle or added to the handle to provide support to a user or to lock particular joints of a user. Additionally a floor mat can be included that can measure weight and balance of the user. A floor mat can also provide positional markings to user to ensure correct positioning of the feet during an exercise. Other hardware features such as virtual reality glasses, force plates, full or partial body suits and attachments, attachments specific to the core or lower extremities, wearable fitness and health trackers, and motion cameras, can be included in or used in conjunction with device 10.

Establishing a Trajectory

As described above, most exercise apparatuses used in training and rehabilitation provide for movement along fixed trajectories. In the exercise apparatuses described in U.S. Pat. No. 5,755,645, trajectories of movements to be performed by a user are pre-programmed. In embodiments of the present invention, trajectories can be defined by users of the exercise apparatus, as opposed to being pre-programmed or otherwise initially restricted. This can provide for more realistic three-dimensional movements and can accommodate the natural, individualized movements of each user. A user-defined, or user-customized, trajectory can thus also result in data that is more meaningful with regard to a relationship between the user's functional performance and his or her muscle strength. Data relating to various performance measurements, such as explosiveness (e.g., a user's ability to achieve a maximal amount of power in a short time interval or in a minimal percentage of total distance traveled), motion quality, motion control, strength, endurance, and fatigue, can also be more meaningful with regard to a user's performance over a user-customized trajectory.

Figure 26:
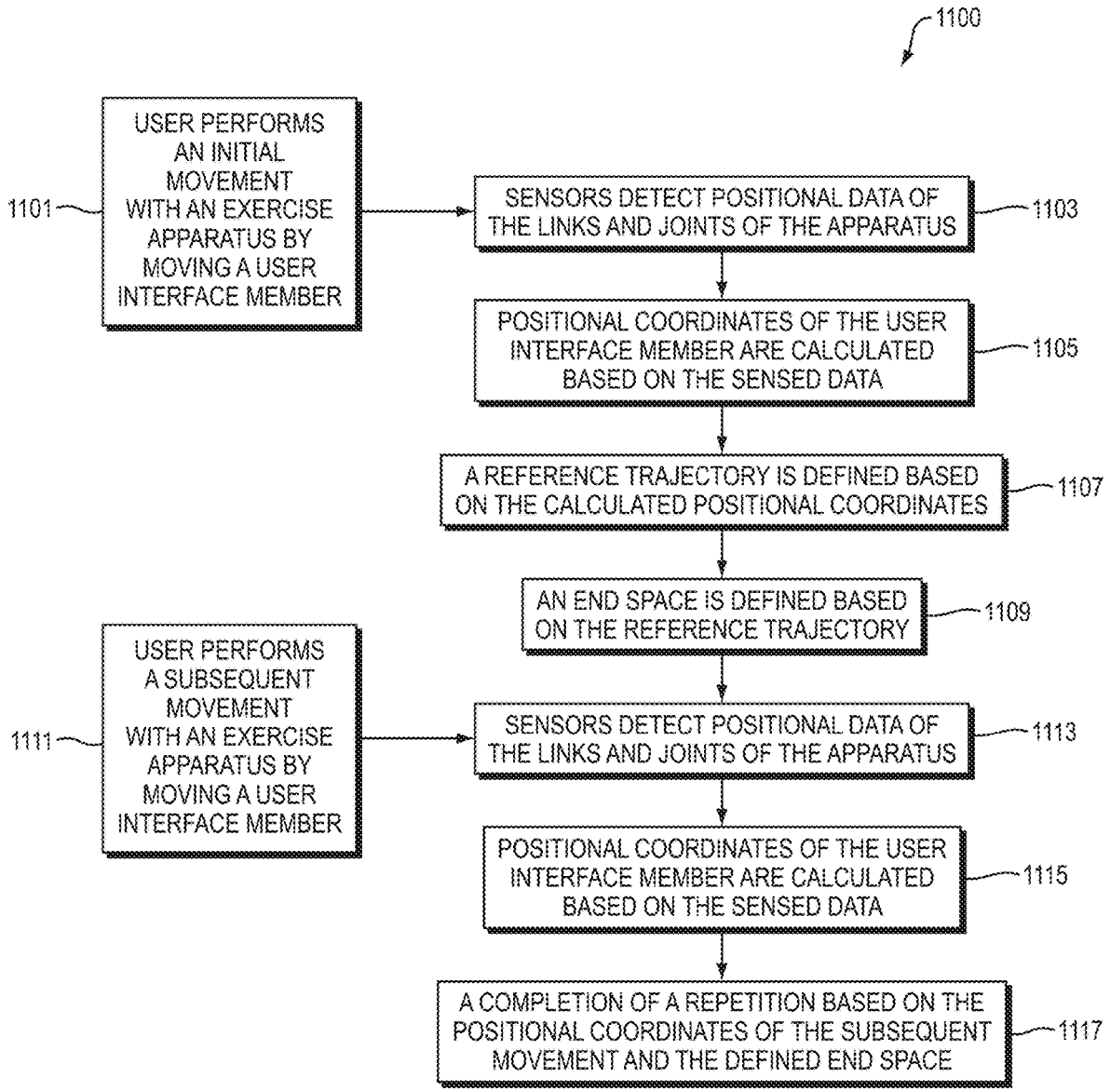
FIG. 26 is a flowchart illustrating a method of providing training or recovery to a user.
Figure 29:
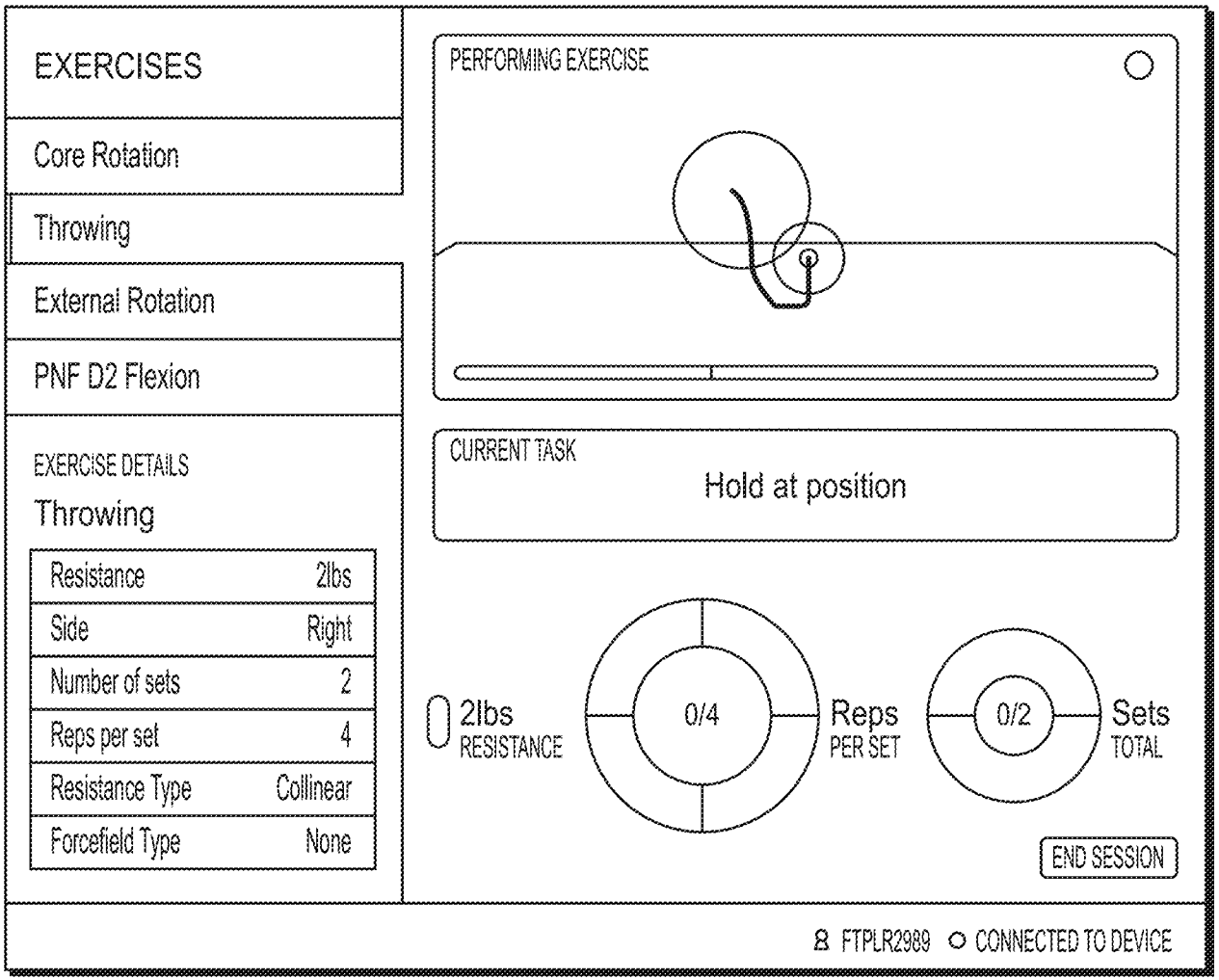
FIG. 29 is an image of an example user interface illustrating a trajectory and user instructions.
Figure 30:
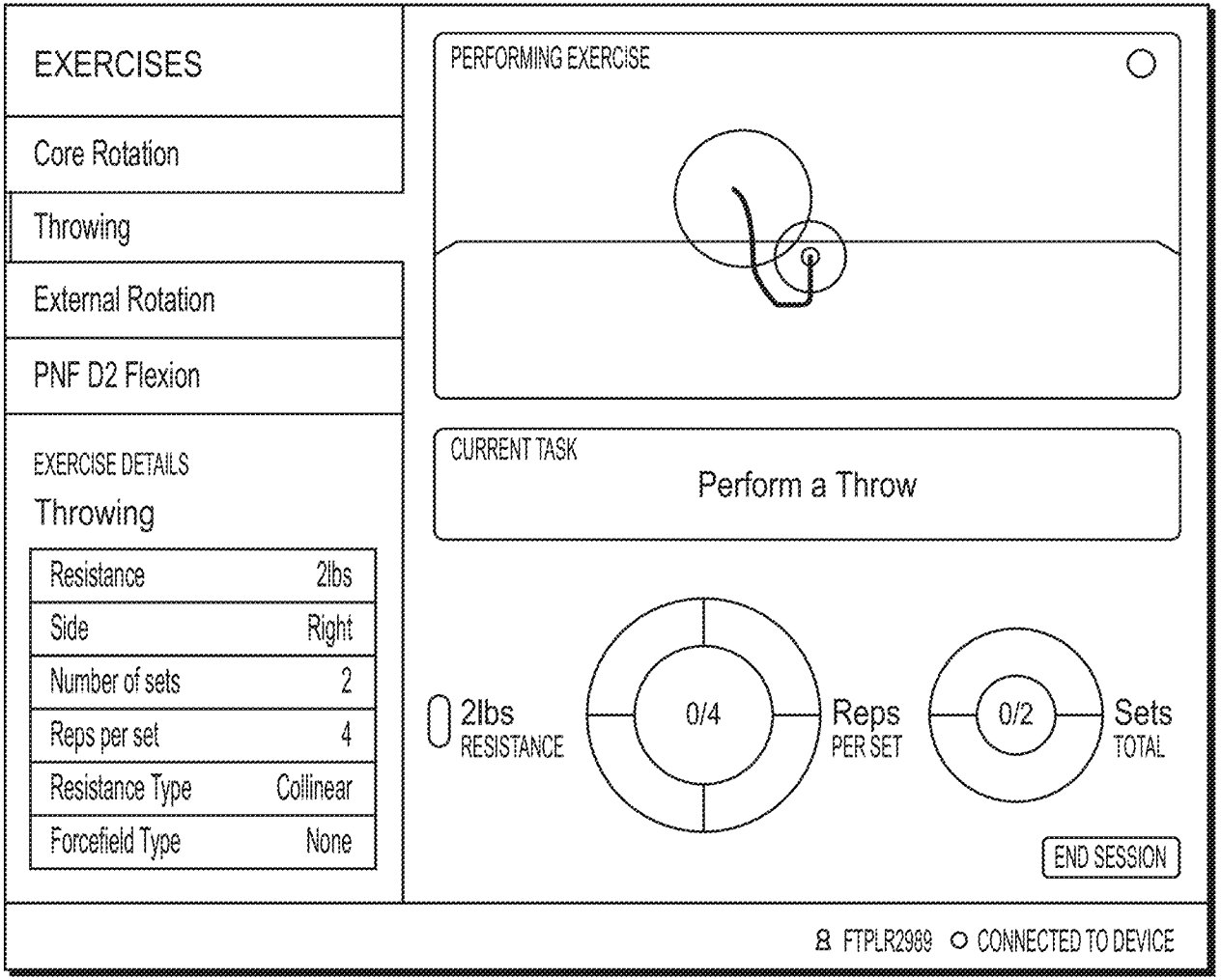
FIG. 30 is an image of another example user interface illustrating a trajectory and user instructions.
Figure 31:
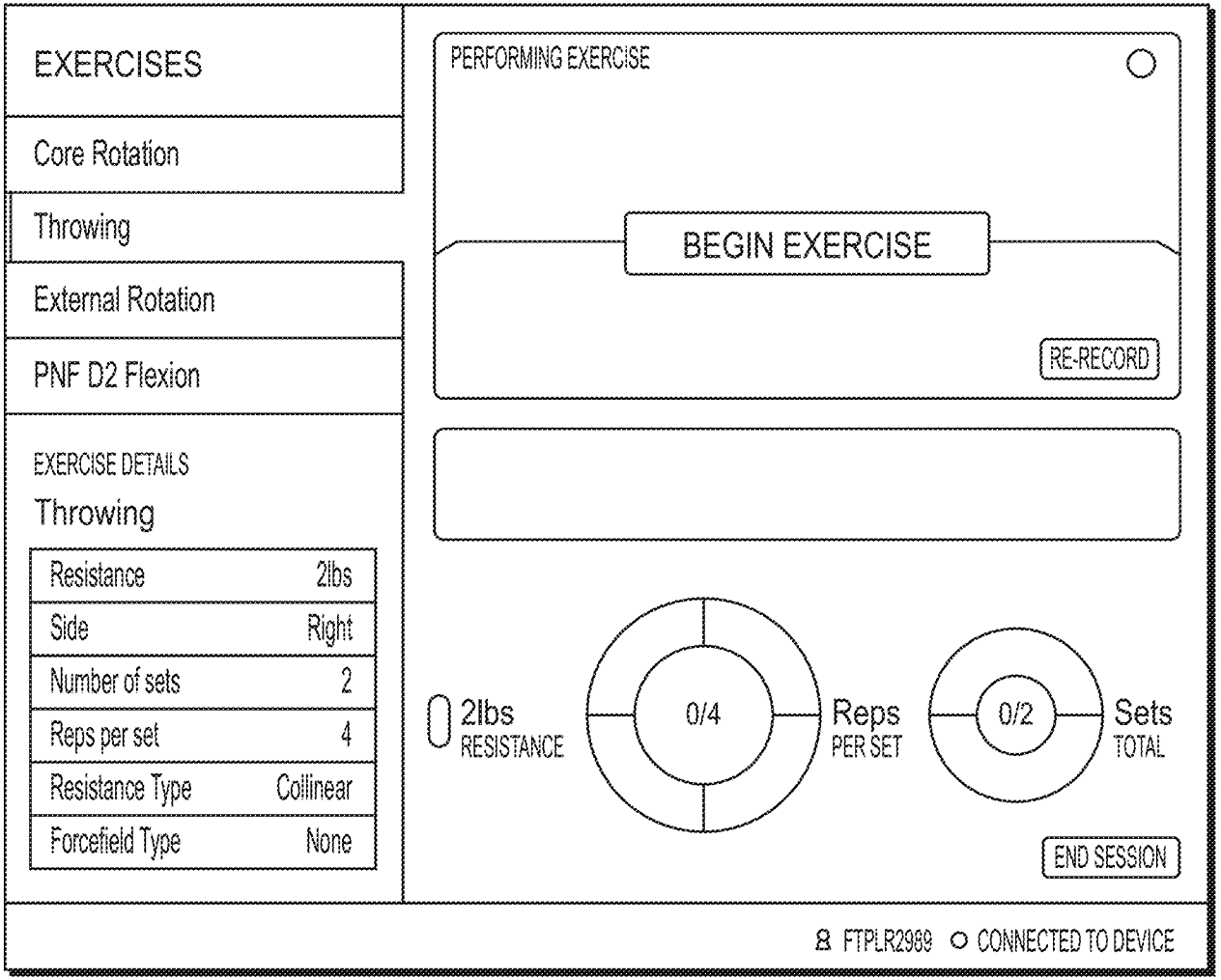
FIG. 31 is an image of an example of a user interface instructing a user to begin exercise.

An example of establishing a trajectory and tracking subsequent movements is shown in FIG. 26. In method 1100, a user can be prompted to perform an initial practice repetition of a movement, such as swinging a golf club or throwing a ball, with the user interface member of the exercise apparatus (step 1101). An example of a user interface instructing a user to begin exercise is shown in FIG. 31. The movement to be performed can be one that is determined by the user or by a trainer or a therapist. Alternatively, the movement can be one that is part of a prescribed exercise regimen, game, or competition. An example of a user interface instructing a user to perform, for example, a throwing motion is shown in FIG. 30. A physical trainer, therapist, or other supervisor can also be prompted to assist the user with performing a desired movement. The supervisor can assist in monitoring, for example, the user's biomechanics, form, limitations of movement, abilities, or other characteristics. Optionally, a prompt can be presented to the user or supervisor to designate restricted areas (e.g., areas into or near which the user interface member should not be moved) for a particular user or for a particular motion. This information can be used to restrict movement of the device to prevent a user from entering the designated areas in subsequent repetitions. A processor can be configured to receive from the sensors of the apparatus positional data of the links and joints over the initial movement of the apparatus by the user (step 1103). The initial movement can be designated as having been completed by the user holding the user interface member steady for a period of time, by the user manually selecting an option, either through the processor interface or with the user interface member, by providing a voice command, or any combination thereof. An example of a user interface illustrating a trajectory and instructing a user to hold at a position upon completion of the movement is shown in FIG. 29.

The processor can then calculate positional coordinates of the user interface member (step 1105). A reference trajectory can be established, from which further repetitions of movements can be compared (step 1107). The reference trajectory can be established directly from the trajectory of the initial movement of the apparatus by the user. Alternatively, the initial movement of the user can be recognized by the system as, for example, a golf swing, and the system can establish a reference trajectory based on a library of trajectories and/or based on an altered or customized trajectory of the initial movement, such that the established trajectory is not identical to the path that was actually taken during the initial movement. This can be desirable where, for example, a user would like to practice a golf swing, but has performed the golf swing incorrectly as determined by the user or supervisor, or as determined by the device based on a detected abnormality for that individual, previously established information pertaining to the individual (e.g., the user's stage of rehabilitation, arm length, flexibility, and/or skill level), previously recorded performance metrics, or any combination thereof. The system can establish a reference trajectory that is corrected from the path of the user's initial golf swing. Based on the reference trajectory, an end space can be defined, such that the apparatus can automatically determine whether subsequent repetitions of the movement are completed (step 1109). As a user performs subsequent movements (step 1111), positional data continues to be sensed (step 1113) and positional coordinates of the repetition trajectory are calculated (step 1115). A completion of a repetition can be determined based on the defined end space and the positional coordinates of the repetition (step 1117).

Figure 3:
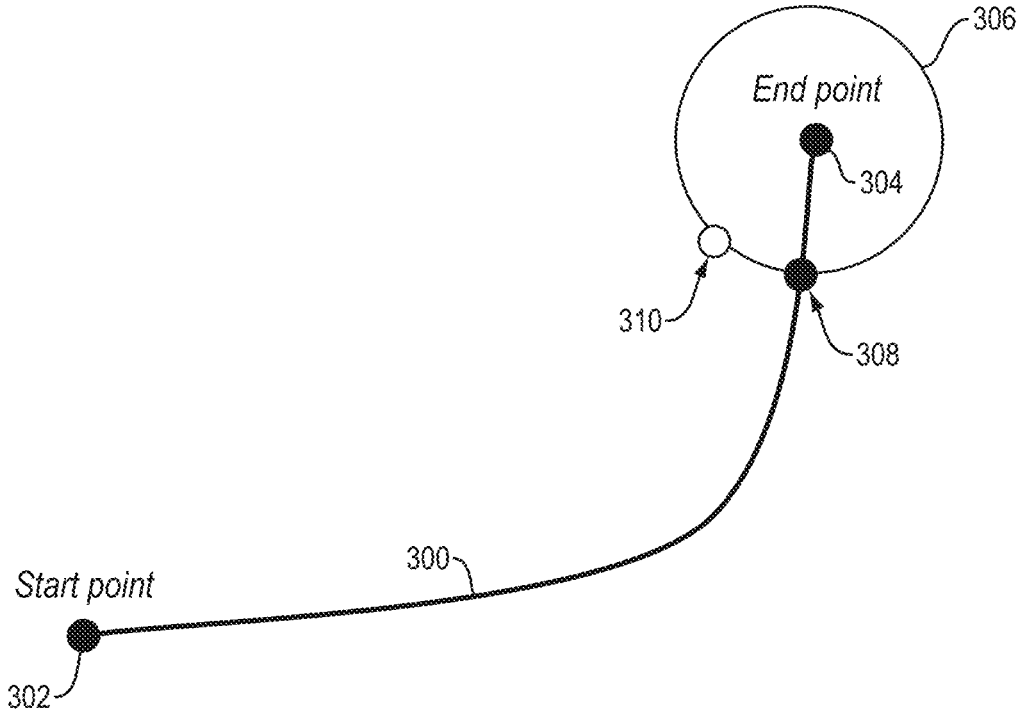
FIG. 3 is a diagram illustrating a trajectory and end point established with an exercise apparatus.

An example of a reference trajectory 300 for a bicep curl is shown in FIG. 3. Based on signals received from sensors within the exercise apparatus, a processor can calculate positional coordinates of the user interface member. In particular, a start point 302 and an end point 304 are recorded for the initial movement. An end space 306 for the exercise can be established based, at least in part, by the end point 304. After the initial movement, or practice repetition, the user begins exercise by repeating the movement. During subsequent repetitions of the movement, once the user interface member enters the end space 306, for example, at point 308, the repetition is counted as complete. In some instances, particularly where complex motions are being performed, the user may enter the end space 306 from a position outside the reference trajectory 300, for example, at point 310. In such a situation, the repetition would still count as having been completed.

The end space 306 can be defined in either two or three dimensions. For example, end space 306 can be a two-dimensional circular area for exercises that are performed within a cardinal plane, such as the bicep curl trajectory shown in FIG. 3. Alternatively, end space 306 can be a three-dimensional volume, such as a sphere or cube, for exercises such as swinging a baseball bat or simulating a baseball pitching motion (FIG. 4A).

The size of the end space can be automatically defined by the processor as a function of the total length of the trajectory or, alternatively, as a function of the length of the trajectory in one or more axes, or other parameters. For example, assuming that the length of trajectory 300 is 30 inches, end space 306 could be defined as a circular area having a diameter of 6 inches, or one-fifth the total distance of trajectory 300. The relative area or volume of an end space to an overall distance of a trajectory can vary depending upon the user, the exercise being performed, and/or performance metrics associated with the reference trajectory, such as the user's average velocity. For example, movements typically performed at higher velocities (e.g., throwing a ball) can have larger end spaces, allowing for more flexibility in completing subsequent repetitions of the movement than would be needed for lower velocity exercises (e.g., performing a bicep curl). The relative area or volume of an end space can also be determined, at least in part, by a user setting or designated mode, such as a precision mode for a small end space or a sport mode for a large end space. A repetition may be counted as complete upon the user interface member entering the end space, or, optionally, by the user interface member entering the end space and movement of the user interface member being stopped for a period of time.

Figure 4A:
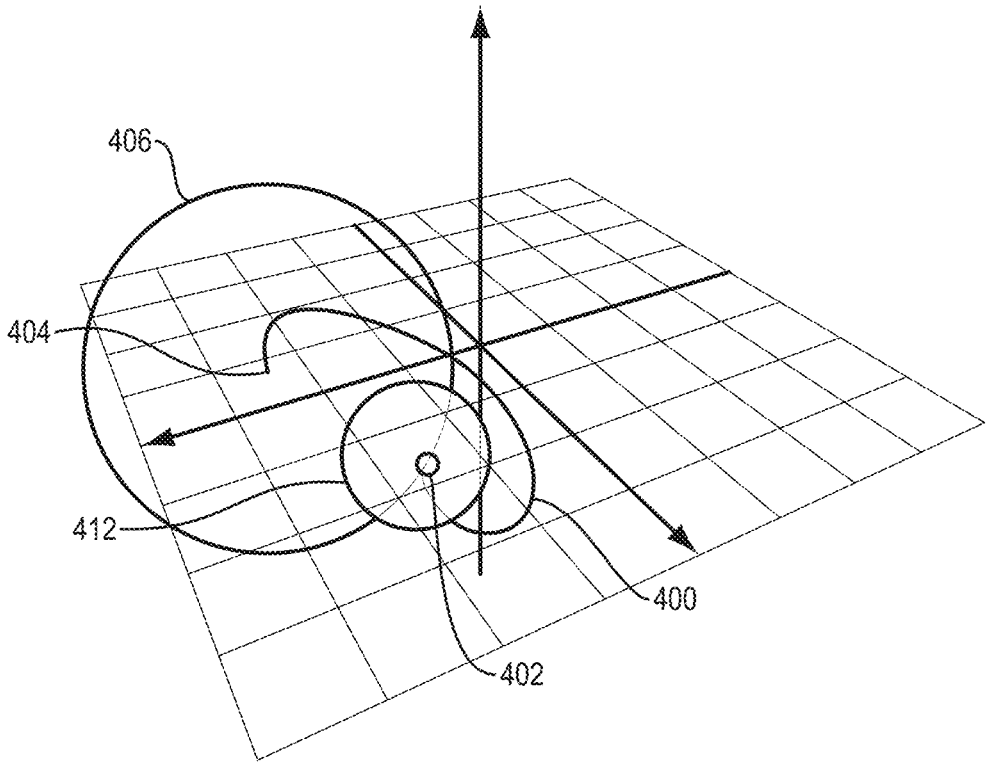
FIG. 4A is a diagram illustrating an example of a trajectory of a first practice repetition with an exercise apparatus.

An example of a three-dimensional reference trajectory 400 is shown in FIG. 4A. The trajectory 400 corresponds to a user having performed a motion with an exercise apparatus that corresponds to throwing a ball. A start point 402 and an end point 404 of the trajectory are shown. In addition to an end space 406, a start space 412 can also be defined. The determination of a start space and end space can allow for the system to recognize the beginning and completion of a practice repetition, without requiring that the user be limited to a fixed trajectory.

Positional Data and Performance Measurements

Figure 7:
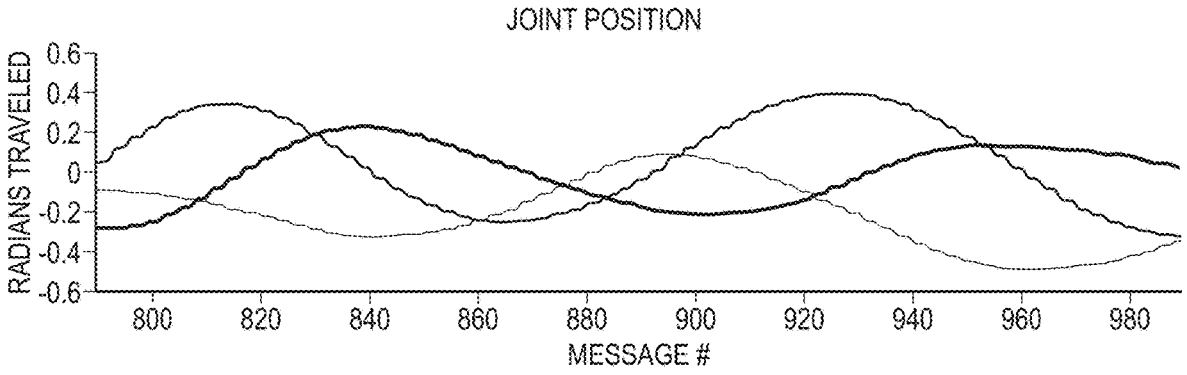
FIG. 7 is a graph of an example of joint position tracking over time.
Figure 17:
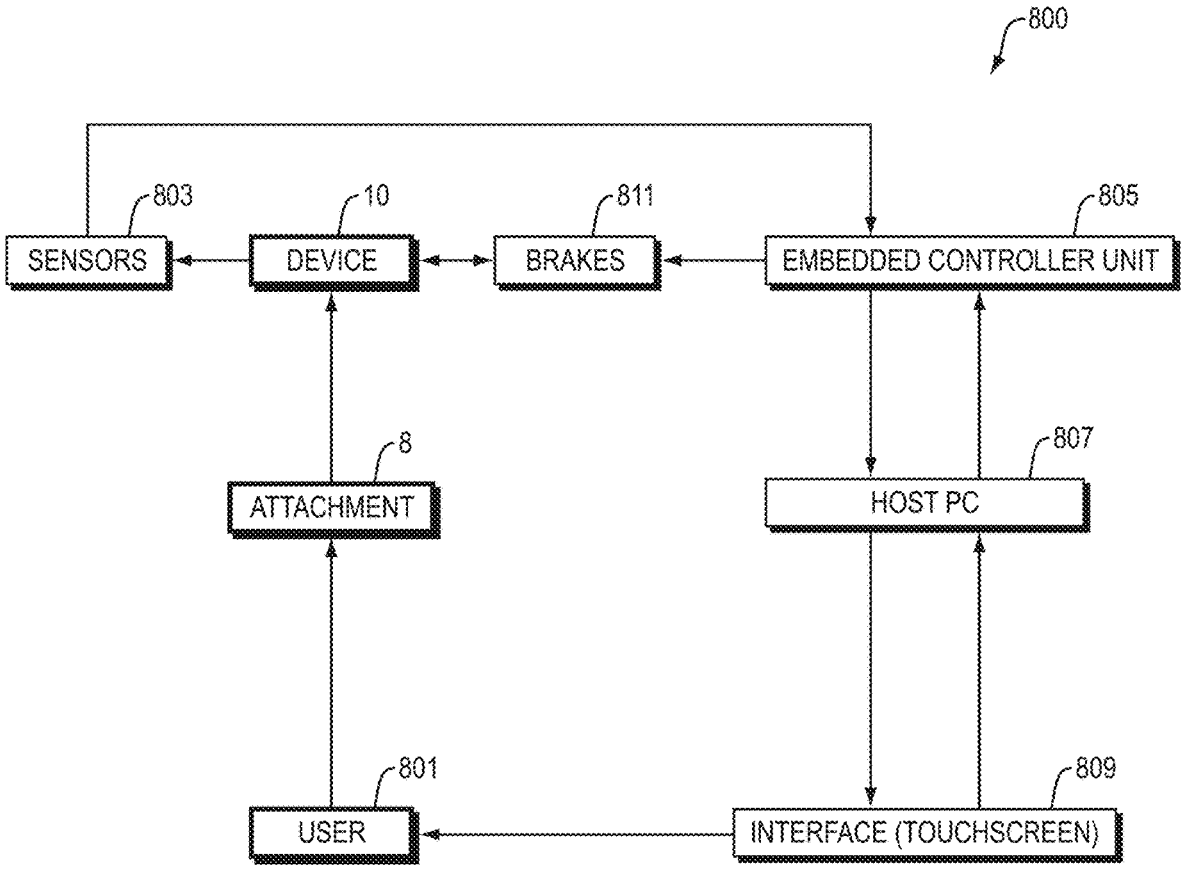
FIG. 17 is a diagram illustrating a high-level system architecture of a training system.
Figure 18:
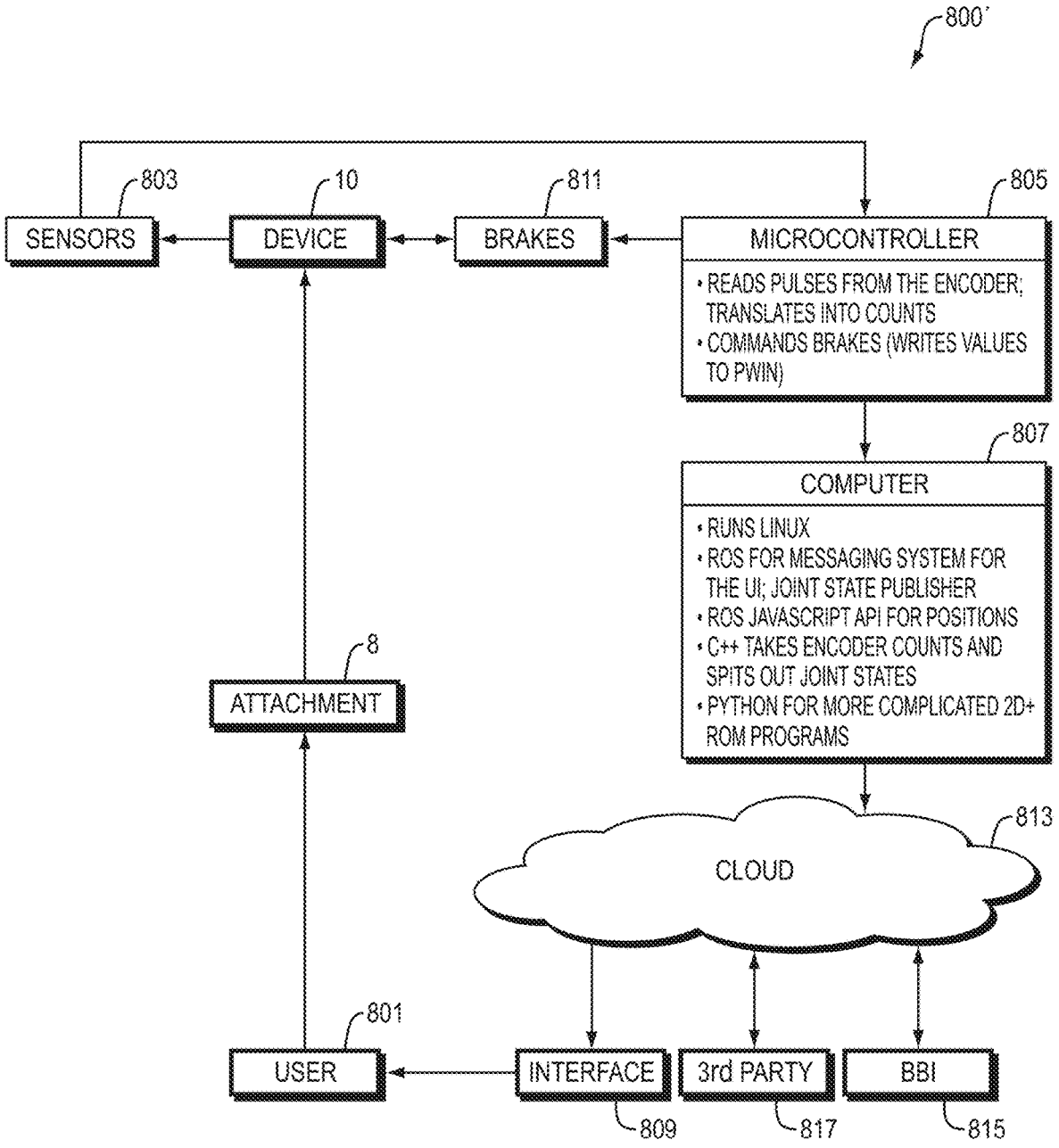
FIG. 18 is a diagram illustrating a high-level system architecture of a training system with cloud capabilities.

As a user moves a device in space, optical encoders on the brake shafts of the device can count electrical pulses corresponding to a change in position. For example with respect to the device 10 of FIGS. 1 and 2, optical encoders at each of B1, B2, and B3 can provide a signal corresponding to a portion of a rotation of each stage of the device. In particular, a sensor S1 located at B1 can detect rotational movement of shoulder member 16 at the rotary shoulder joint 46 (indicated by arrows 103 and referred to as the waist stage); a sensor S2 located at B2 can detect rotational movement of the turret 14 at the rotary waist joint 48 (indicated by arrows 101 and referred to as the base stage); and a sensor S3 rotationally associated with brake shaft 50 and B3 can detect linear movement of arm member 18 relative to shoulder member 16 along sliding joint 44 (indicated by arrows 105 and referred to as the linear stage). The detection of movement of each member or link of the device 10 can be direct or indirect. For example with regard to sensor S3 and as shown in FIG. 2, the sensor S3 can indirectly detect linear movement of arm member 18 by sensing the rotational displacement of brake shaft 50 that is rotated by associated pulleys and cables. The configuration of the sensors also enables a determination as to direction, such as whether a rotation (e.g., rotation of brake shaft 50) is clockwise or counterclockwise. Sensors S1, S2, S3 can be any sensor capable of providing position, velocity, and/or acceleration feedback, such as, for example, optical encoders, resolvers, magnetic encoders, hall effect encoders and the like The number of pulses per full revolution of each brake shaft is known (e.g., 500 pulses per full revolution). Accordingly, the number of radians traveled for a given pulse (e.g., $2\pi/500$) can be calculated for each of the three sensors S1, S2, and S3, as illustrated in FIG. 7. The time between measurements is also known. As such, the angular velocity of each brake shaft can also be determined. Calculations for the radians traveled and angular velocities at each brake shaft can be performed in an embedded micro controller (FIGS. 17 and 18).

As the gear ratios along each axis are also known, the angular distances and velocities of the base and waist stages and the linear distance and velocity of the linear stage can be calculated. For example, a single rotation of the base stage can correspond to a particular number of rotations of the B2 brake shaft (e.g., 40 rotations) through the gearing mechanism. From this information, the position of the user interface member in three-dimensional space can be determined.

Figure 5A:
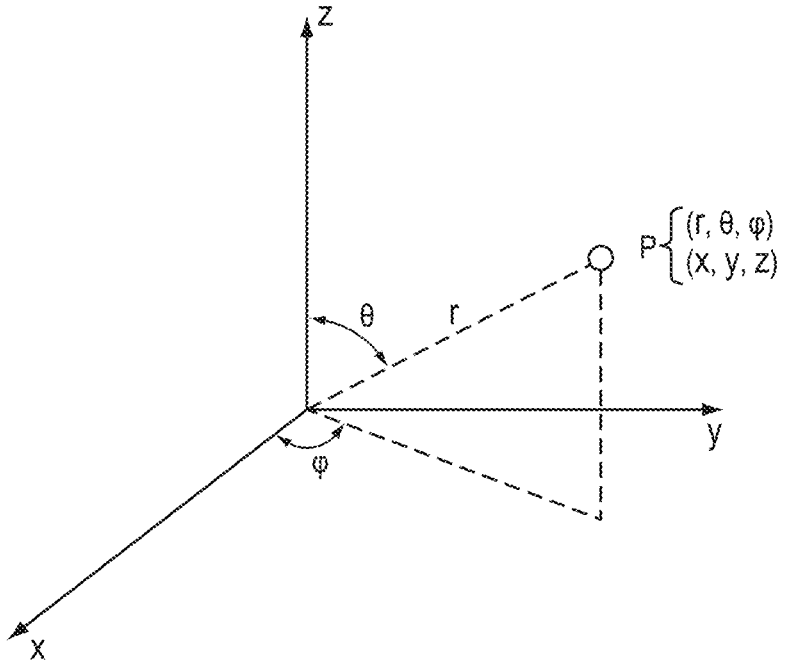
FIG. 5A is a diagram illustrating an example of a positional coordinate of a user interface member in a three-dimensional (3D) space.

In one method, the device 10 can be considered to provide a spherical workspace, with the position P of the user interface member at any point along a trajectory being defined by, for example, a radial distance r (corresponding to linear movement of arm member 18), polar angle θ (corresponding to angular movement of the shoulder joint 46), and azimuth angle φ (corresponding to angular movement of waist joint 48), as shown in FIG. 5A. The position P(r,θ,φ) can be re-expressed in Cartesian coordinates as P(x,y,z) by use of the following equations.

$$x=r\sin\theta\cos\varphi \tag{1}$$

$$y=r\sin\theta\sin\varphi \tag{2}$$

$$z=r\cos\theta \tag{3}$$

In another method, a kinematic model of the device 10 can be built using the Denavit-Hartenberg Parameters (DH Parameters) with a position P of the user interface member, alternatively referred as an end-effector, being calculated based on forward kinematics. Derivatives of the kinematics equations with respect to time can be obtained, providing the Jacobian of the device 10, and velocity of the user interface member at each position P can be recorded. Alternatively, or in addition, a second derivative of the kinematics equations with respect to time can be obtained to provide for acceleration of the user interface member at each position P.

In another method, the positional data P (x,y,z) is derived from a linear acceleration of the user interface member, as measured by a sensor S4 located at the user interface member, such as an inertial measurement unit or related technology. When transformed into a fixed coordinate system, linear acceleration data can be integrated twice to yield a displacement of the user interface member. An absolute position of the user interface member can be tracked if the user interface member starts from a predefined point. Additionally, the accuracy of the system can be improved if data from two or more inertial measurement units at the user interface member are fused using techniques such as the Kalman filter.

Calculations for position, velocity, and/or acceleration values of the user interface member over a trajectory can be performed in a customized node of a host PC (FIGS. 17 and 18), including the use of open-source or closed-source platforms that provide a similar framework.

Figure 4B:
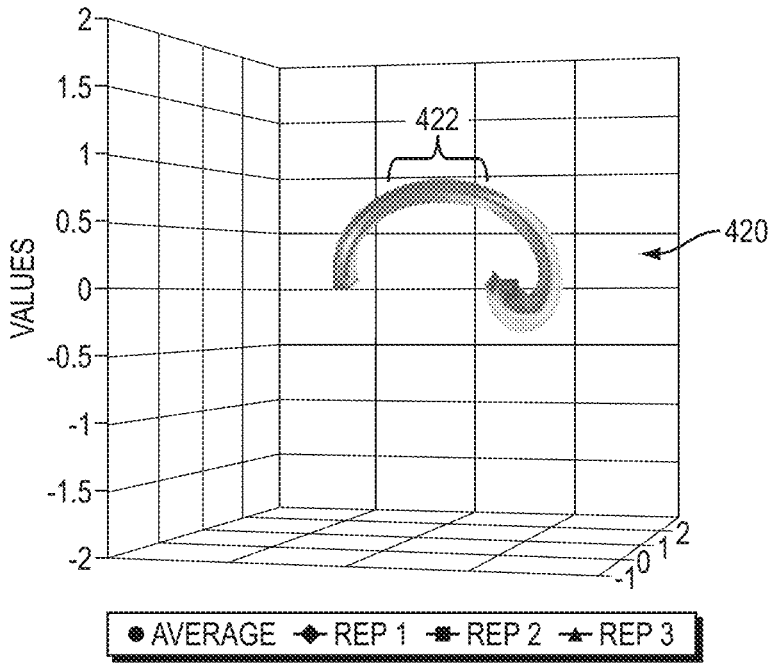
FIG. 4B is a graph illustrating power as a function of position over several repetitions of the trajectory of FIG. 4A.
Figure 4C:
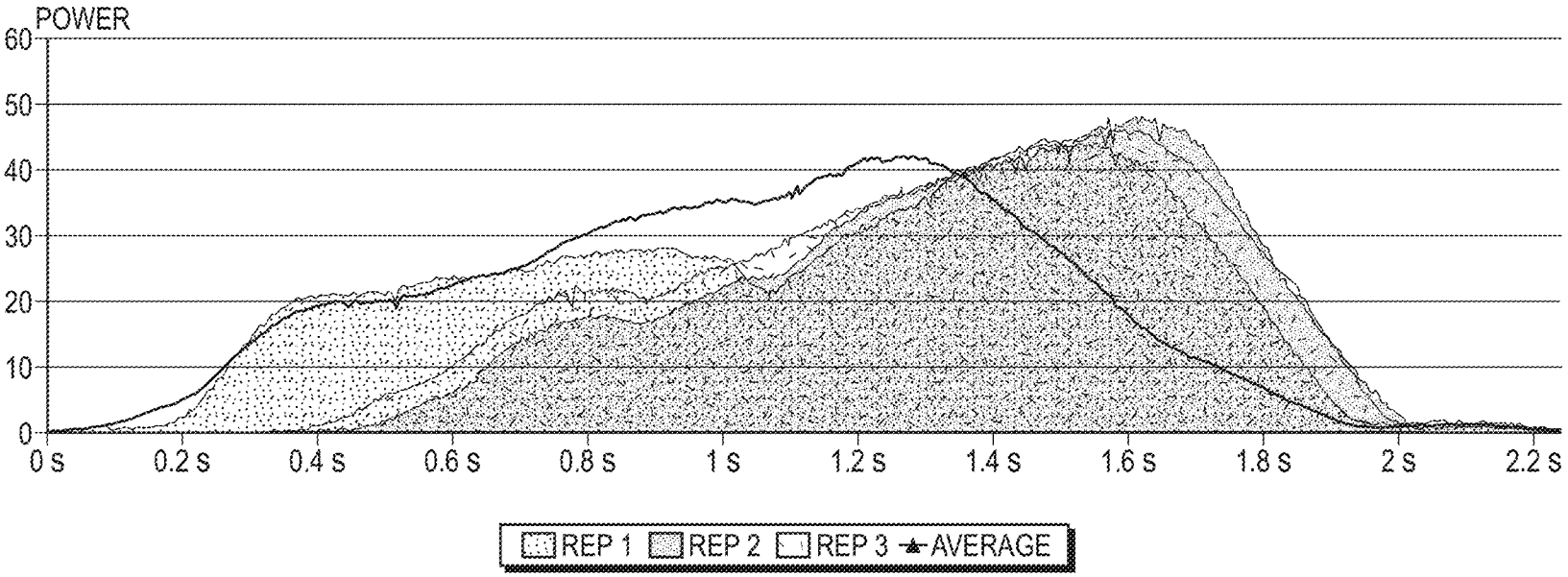
FIG. 4C is a graph of power as a function of time for several repetitions of the trajectory of FIG. 4A.

Recording of user generated movements, such as bicep curls (FIG. 3) and ball throws (FIG. 4A), can thus include, position, velocity, and acceleration data at several points along a trajectory of the user. In addition to velocity, the system can also record other performance metrics derived from position and/or velocity at several positional coordinates along the trajectory. For example, a graph 420 of the trajectory 400 is shown in FIG. 4B, which illustrates power as a function of position. The graph 420 includes data collected over three repetitions of a ball throwing motion and relative amounts of power over the trajectory are shown in greyscale. As can be seen in region 422 of graph 420, the user's power is highest at the upper arc of the throwing motion, as reflected by the darkened coloring in this region. A graph reflecting power over time for the three repetitions, as well an average over the three repetitions is shown in FIG. 4C.

Figure 5B:
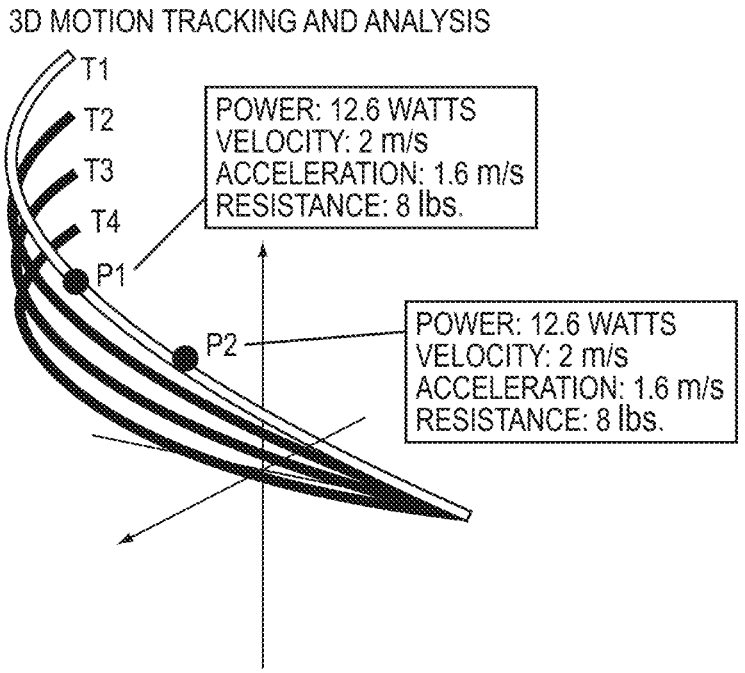
FIG. 5B is a diagram illustrating an example of three-dimensional (3D) motion tracking and analysis.

Performance metrics for each position P along a trajectory can be obtained and presented to a user of the system, as illustrated in FIG. 5B. In particular, velocity and acceleration at each recorded position, such as $P_1$, $P_2$, can be obtained. Additionally, as resistance values of the brakes are known, an overall resistance experienced by the user can be determined, along with power for each position $P_1$, $P_2$. Performance metrics can be obtained for individual recorded points at approximately 2 mm intervals, providing for high-resolution data over a recorded trajectory.

Figure 6:
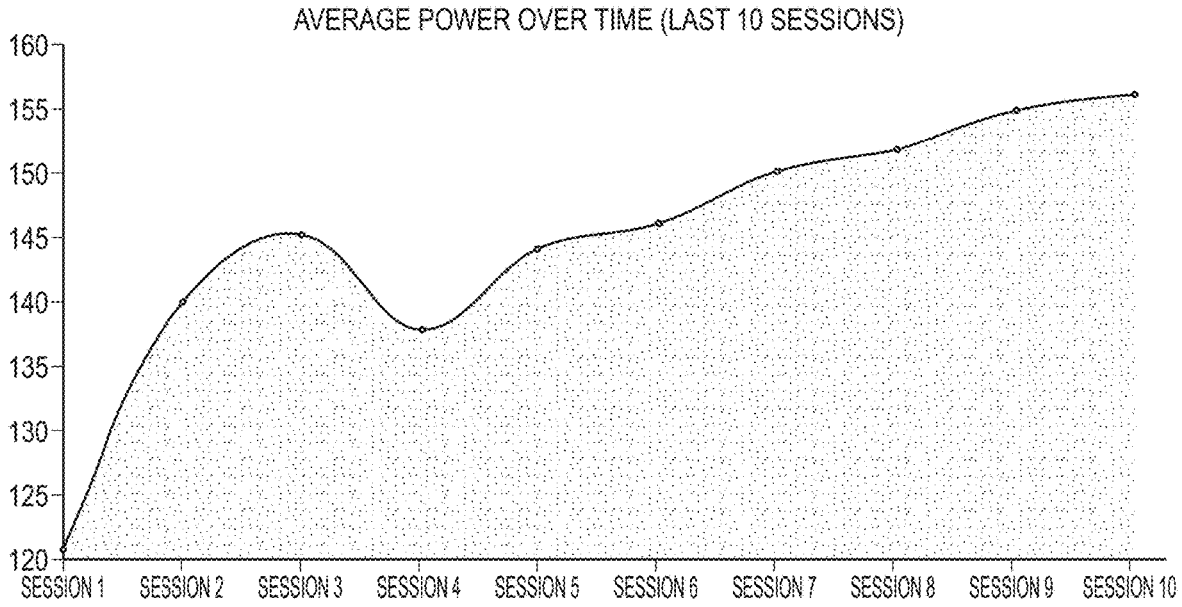
FIG. 6 is a graph of an example of average power over multiple training sessions.

As shown in FIG. 5B, a user of the system is able to view several repetitions of an exercise, for example, corresponding to trajectories $T_1$-$T_4$, and obtain performance metrics at any point along each of the trajectories. In addition, an average power for each exercise session can be obtained and compared over time, as shown in FIG. 6.

Figure 8:
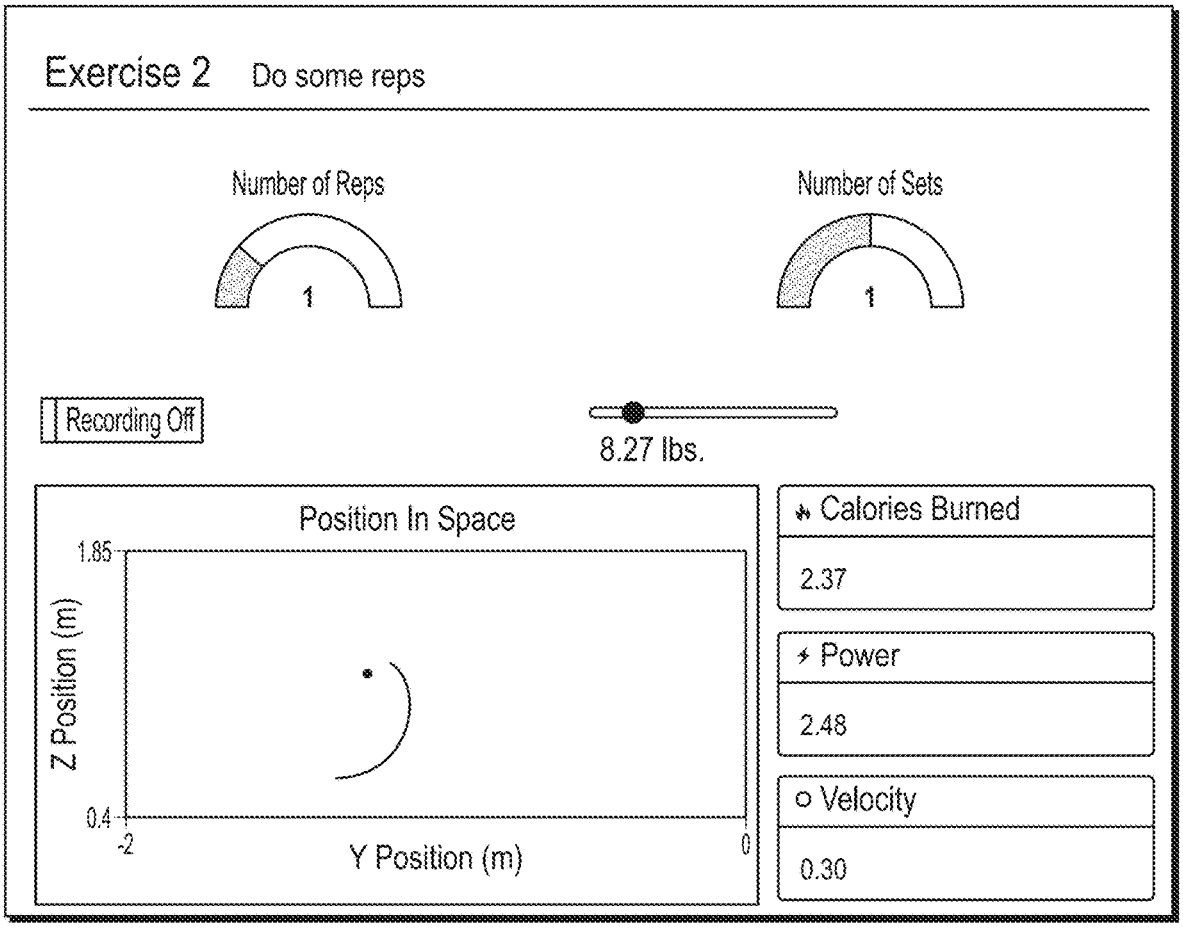
FIG. 8 is a graph of an example of a user interface with position tracking and associated metrics.
Figure 9:
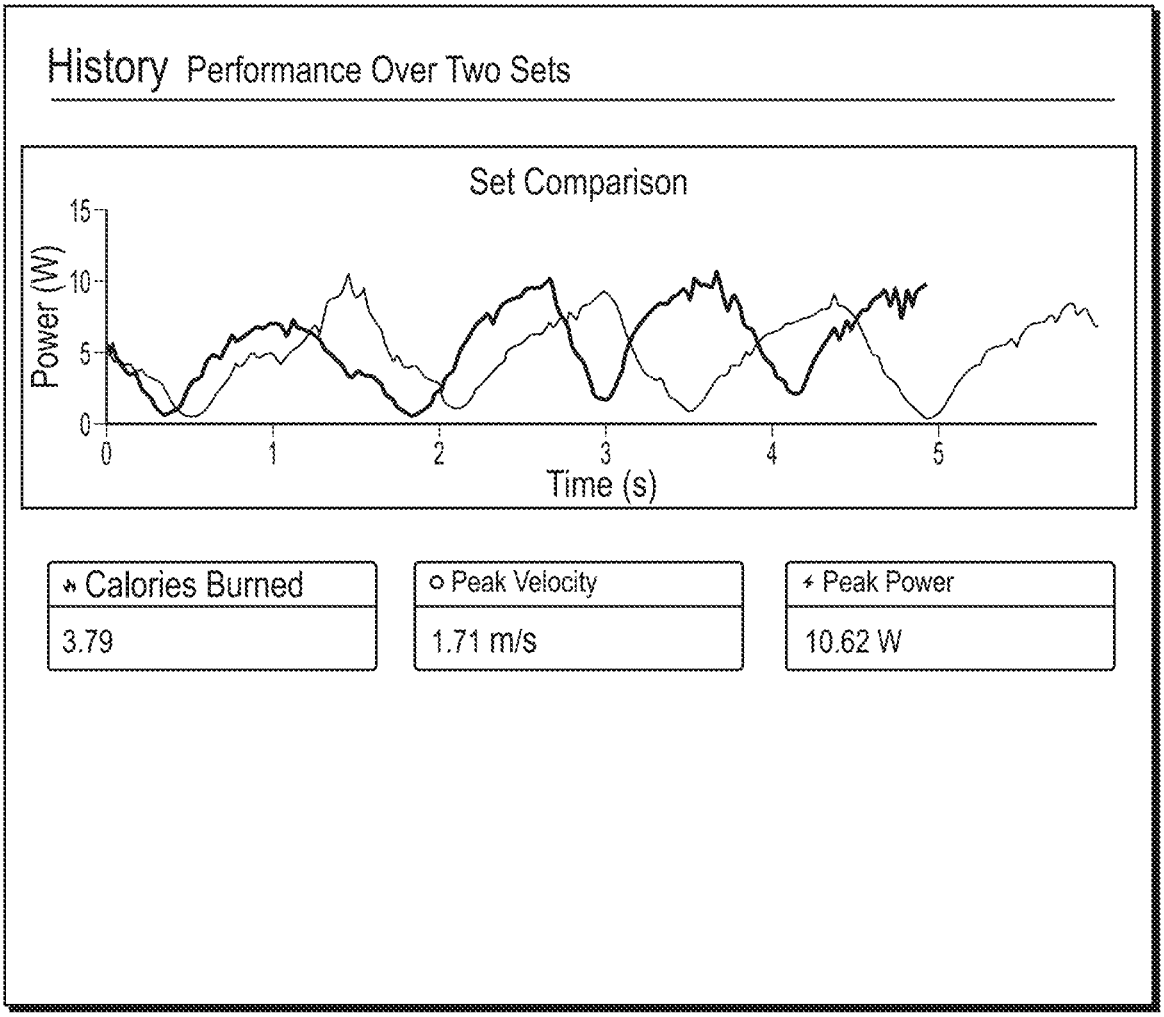
FIG. 9 is a graph of an example of a user interface displaying power over two sets of an exercise and associated metrics.
Figure 32:
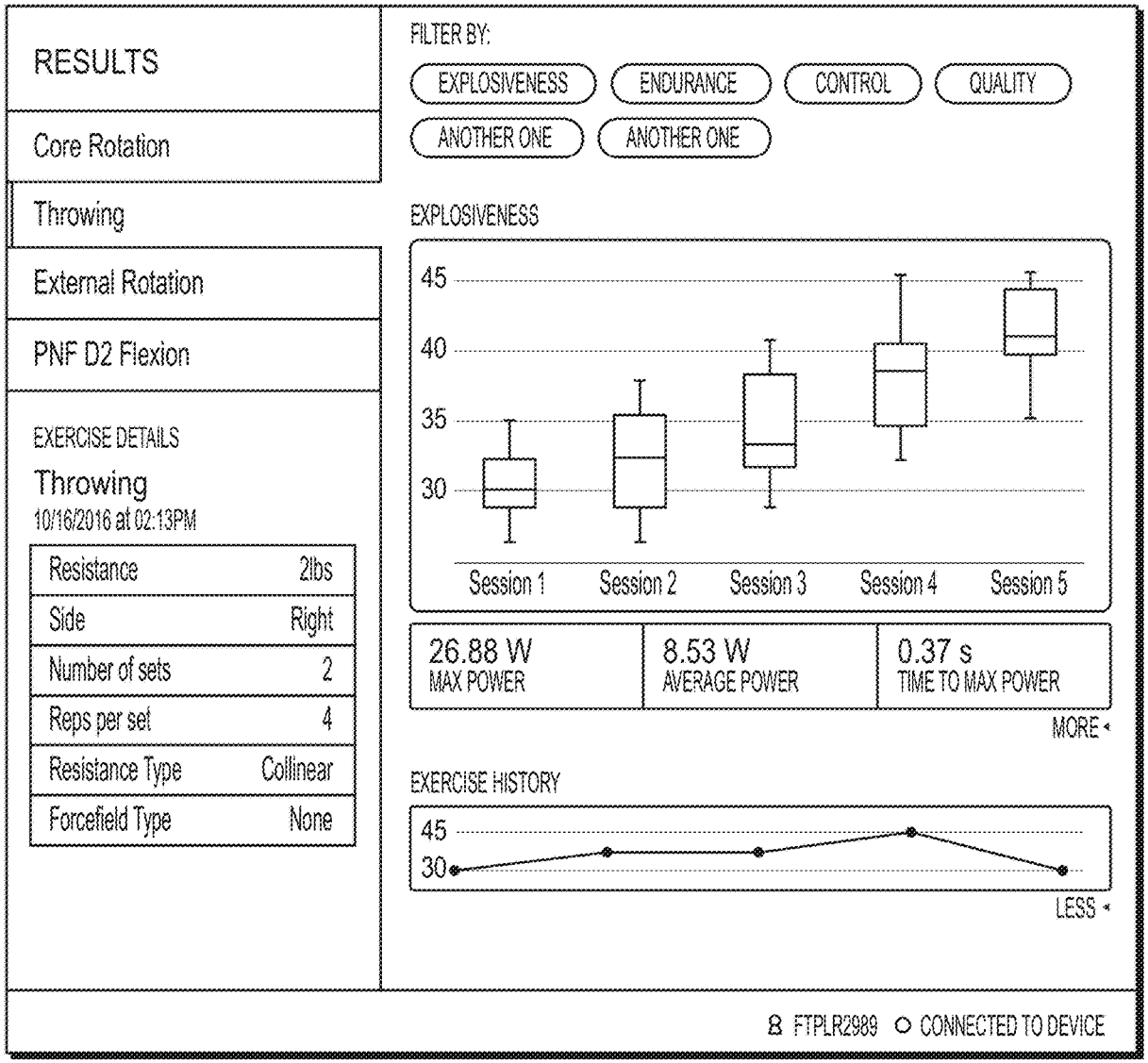
FIG. 32 is an image of an example of a user interface illustrating performance metrics to a user.

Examples of performance metrics and other information that can be displayed to a user are shown in FIGS. 8 and 9. In particular, as shown in FIG. 8, a user can be provided with a graph illustrating his position in space, number of repetitions and exercise sets performed, a current resistance level, power, velocity, and calories burned. This information can be provided in real-time to a user as an exercise set is being performed. A user can also view historical data, as shown in FIG. 9, where a comparison of power over multiple exercise sets is shown along with total calories burned, peak velocity, and peak power. An example of a user interface displaying performance metrics, for example, explosiveness, is shown in FIG. 32.

Locked Trajectories

An exercise device, such as device 10, can be configured to provide varying types of resistances such that guidance can be provided to the user to encourage certain movements while not overly restricting the user. In one method, resistances are provided to construct a locked trajectory for the user. Also, resistances can be based, at least in part, on performance parameters of a user's motion, such as position, velocity, or acceleration, to provide a safer or more comfortable training environment.

In some instances, it is desirable to restrict a user to a particular space or movement, where the user cannot move the user interface member outside of a desired trajectory. With conventional exercise devices, force fields are typically applied with active forces (e.g., by a motor) such that a user cannot deviate from a desired space or trajectory. With passive exercise devices, where motors are not used to provide resistance, the creation of a force field by application of high resistances can create an awkward feeling, where the user can become "stuck" in a high resistance field when deviating from the trajectory. This effect can be very noticeable and disruptive to the user, particularly during high velocity movements. For example, during a golf swing, a user can plunge the user interface member into a high resistance force field, which disrupts movement fluidity and creates difficulty for the user to correct the motion by moving back to the desired trajectory.

In one embodiment, an exercise device can be programmed to provide a locked trajectory without a force field that is disruptive to the user's movement. To control divergent movements without the awkward, sticky feeling described above, an exercise system can be configured to isolate one of the three joints of the exercise device, thereby permitting the user perform a one-plane or two-plane movement.

Figure 10:
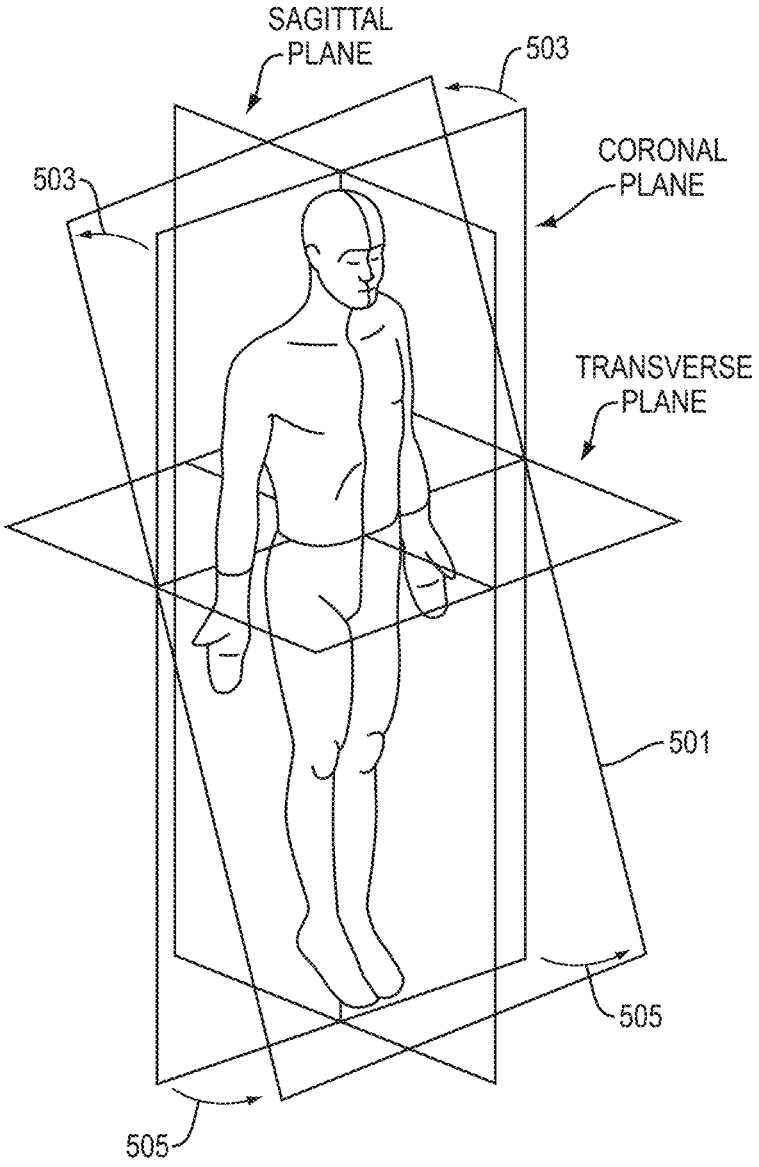
FIG. 10 is an image depicting cardinal planes for locked trajectory movements.

In particular, movement can be limited to one of the three cardinal planes, illustrated in FIG. 10. The sagittal plane is perpendicular to the ground, dividing the body between right and left sections. To restrict movement to a sagittal plane (e.g., a midsagittal plane, which passes through the midline of the body, or a parasagittal plane, which runs parallel to the right or left of the midsagittal plane), the base stage of the device 10 can be locked while movement in the waist and linear stages of the device 10 is permitted. In other words, a high resistance level can be set for B2, such that a user is unable to cause the device 10 to rotate along arrows 101 (FIGS. 1-2) but can cause the device to move along arrows 103 and 105. An example of a sagittal plane movement is a bicep curl, which requires up-down and in-out movement, but not side-to-side movement.

The coronal plane is perpendicular to the ground, dividing the body between dorsal and ventral sections. Locking the linear stage of the device 10 while allowing movement in the base and waist stages causes the device 10 to restrict the user to coronal plane movements. For example, arm lifts require up-down and side to side movement, but not in-out movement. Accordingly, a high resistance level can be set for B3, such that a user is unable to cause the device 10 to slide along arrows 105 but can cause the device to move along arrows 101 and 103.

The transverse plane is parallel to the ground and divides the body into cranial and caudal portions. Locking the waist stage of the device 10 while allowing movement in the base and linear stages causes the device 10 to restrict the user to transverse plane movements. For example, external rotations require in-out and side-to-side movement, but not up-down movement. A high resistance level can be set for B1, such that a user is unable to cause the device 10 to rotate along arrows 103 but can cause the device to move along arrows 101 and 105.

Locking one stage of the device 10 can restrict a user's movement to a cardinal plane without the user encountering the sticky resistance of a force field. This feature is also helpful in the case of a user having had an injury. The injured user can be constrained to a particular range of motion to prevent negatively affecting the injury. For example, a user with sutures from a surgery can be restricted from performing movements that cause the user to extend their arm in a manner that could compromise the sutures. Further, for example, a physical therapist or trainer can use this feature to assess a user's movement and performance in designated body planes for better assessment, analysis, and personalization of treatment.

While the locking of one of the mechanical stages of the device 10 can be accomplished by setting a maximum resistance level to one of the brakes, in some instances it may be desirable to adaptively set the resistance level of the brake. In particular, a resistance level for a spatial restriction can be based, at least in part, on the user's movement characteristics, such as velocity, power, acceleration, work, or other such metrics. For example, where a user is performing a movement at a high velocity, encountering a hard stop or locked brake could cause pain or injury. Rather than setting a maximum resistance level of the brake, a gradually resistive force can be applied to slow the user down rather than causing an abrupt stop.

Locking one stage of the device 10 can also be useful for sports motions or complex trajectories that typically require multi-plane movements. For example, a golfer training with a rotational movement can be confined to trajectories within the coronal plane by having the base and waist stages of the device 10 activated, while the linear stage is locked. To more comfortably match the movement of a golf swing, the device 10 can provide for an adjusted coronal plane 501. In particular, the coronal plane is tilted backwards with respect to a head of the user, in the direction of arrows 503, and forwards with respect the feet of the user, in the direction of arrows 505. To provide for the adjusted coronal plane 501, either the device 10 itself can be tilted, lifted, lowered, or otherwise moved, or the arm 18 can be angled upward with respect to the shoulder member 16.

By locking linear stage movement of the device 10, the user is prevented from making extraneous in-out movements during a golf swing. Practicing in a locked trajectory can thus prevent fatigue due to extraneous motion and can provide enhanced isolation of target muscles. Furthermore, this can prevent abnormal movement patterns that may predispose a user to an injury.

While locking one or more stages of a device is useful for limiting a user to trajectories in one or two planes without the user encountering an awkward, sticky resistance, guidance for movement over complex, three-dimensional trajectories can also be provided, such as through invisible hand assistance.

Invisible Hand Trajectory Control

In training, exercise, and physical rehabilitation, there is often a need for assisting a person through a motion over a desired trajectory. Hands-on assistance is often provided during the training or rehabilitation process to help the person maintain a complex movement pattern or to alleviate exertion over several repetitions of an exercise. Typically, a physical therapist or athletic trainer stands nearby to the person while he or she performs an exercise (e.g., a bicep curl, external rotation, etc.) or sport motion (e.g., a golf swing) and provides hands-on assistance to ensure that the person stays within a safe range of motion and/or maintains proper form. The person's training or recovery thus depends, at least in part, on the skills of the therapist or trainer. Often times, hands-on assistance can lack precision, adequate control, stability, or safety. There is a need for robotics that can provide a user with consistent and safe assistance over complex trajectories.

Existing rehabilitation robotics are geared towards the treatment of patients that have suffered acute injuries (e.g., stroke victims) and who are in need of regaining or relearning basic motor skills. However, an athlete, gym-goer, or sports-rehabilitation patient generally has adequate motor skills and is seeking training with respect to complex motions. Robotics geared towards the rehabilitation of patients with respect to basic motor skills are inadequate for use with athletic training or sports rehabilitation because they typically do not allow for an adequate range of motion, cannot be used to perform complex motions at higher velocities, and/or do not capture and provide meaningful data for the user.

In one embodiment, an exercise device can be programmed to provide passive assistance, also referred to as "invisible hand" assistance. Invisible hand assistance can be reactive to a user's unique velocity and position in space and can be used to produce a more controlled movement over a trajectory than free-form resistance. Rather than confining a user to a particular trajectory, as is frequently encountered in both traditional and isolated-movement exercise equipment, invisible hand assistance can influence a user's trajectory without pushing and without the use of motors. This can allow for a more natural and fluid motion on the part of the user and can allow the user to deviate, make a mistake, and self-correct without interruption of motion.

Figure 11A:
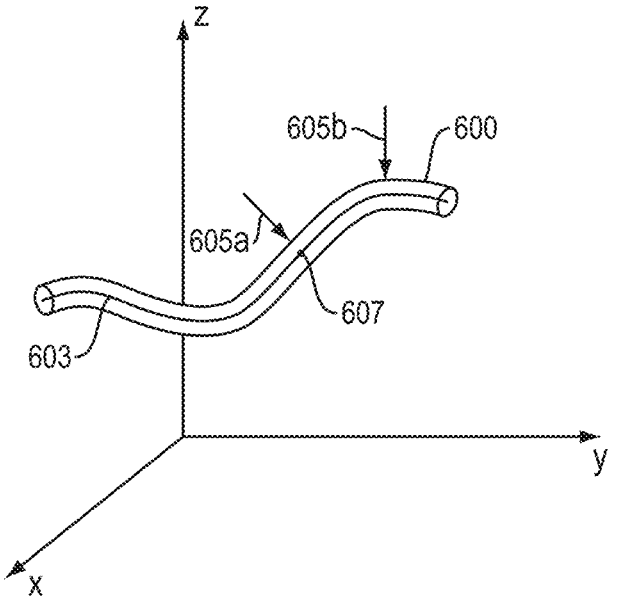
FIG. 11A is diagram illustrating a corrective force applied perpendicular to a trajectory.

As described above, the application of a force field can result in an awkward, sticky feeling for the user when deviating from an assigned trajectory. An example of a force field 600 surrounding a desired trajectory 603 is shown in FIG. 11A. Typically, the force field 600 is established with corrective forces applied in a direction perpendicular to the trajectory 603, as shown, for example, with corrective force vectors 605*a*, 605*b*. If a user deviates at point 607 on the trajectory 603, the user experiences a sticky resistance from force vector 605*a*, which interrupts the user's motion.

Figure 11B:
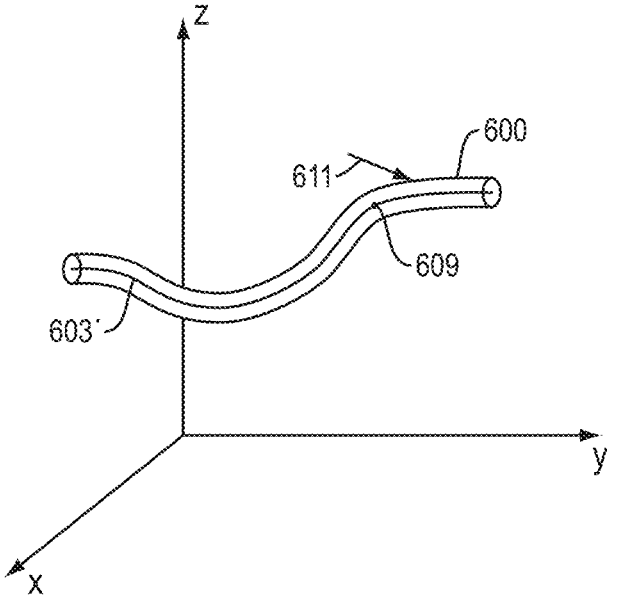
FIG. 11B is diagram illustrating a corrective force for "invisible hand" trajectory control.

Rather than apply resistive forces in a direction perpendicular to the desired trajectory, an exercise device can be programmed to provide invisible hand assistance by applying a corrective force located further along the trajectory and angled towards the force field. For example, a force field 600' over a desired trajectory 603' is shown in FIG. 11B. If a user deviates from the trajectory 603' at point 609, a corrective force can be applied as illustrated by corrective force vector 611. In particular, invisible hand assistance attempts to repoint the user's velocity vector such that the user returns to the desired trajectory 603'. The corrective force vector 611 is not pointing directly towards the trajectory 603', but rather at a point further along the trajectory and at an angle dependent upon the user's velocity, the user's position in relation to the desired trajectory, and, optionally, any other relevant metrics, such as power. Invisible hand assistance provides a corrective force that is subtler and more considerate of the user's movement, such that movement is influenced and not disrupted.

Once a user performs an initial practice repetition of an exercise, the exercise system can recognize the motion pattern (e.g., a golf swing). The device then sets a force field around the desired trajectory and can also, optionally, display a visual representation of the trajectory to the user. As the user performs a repetition of the motion, invisible hand assistance can be provided if the user deviates from the desired trajectory. The user can then correct form, hand position, and/or other controlling factors to maintain the desired path.

Figure 12A:
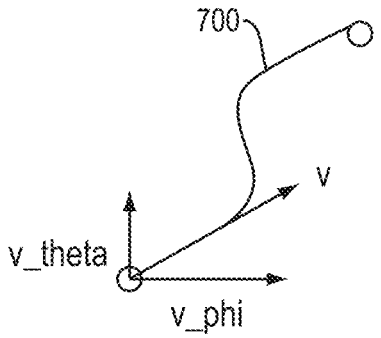
FIG. 12A is a diagram illustrating a velocity vector of a correct movement over a trajectory.
Figure 12B:
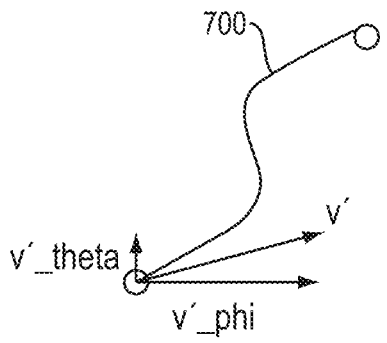
FIG. 12B is a diagram illustrating a velocity vector of an incorrect movement over the trajectory.

An example of invisible hand assistance is shown in FIGS. 12A-12D. A desired trajectory 700 is shown in FIG. 12A with a correct movement by a user represented by velocity vector V. The velocity vector V includes spherical components V_phi and V_theta. Velocity vector V indicates that the user is moving appropriately to stay on track with trajectory 700. In contrast with FIG. 12A, an incorrect movement on the part of the user is represented in FIG. 12B with velocity vector V', which includes components V'_phi and V'_theta. As illustrated, the user is moving in a direction that will cause the user to deviate from trajectory 700. In particular, the user's angular movement is skewed too heavily in the direction of azimuth angle $\varphi$, as represented by the increased magnitude of V'_phi and decreased magnitude of V'_theta.

Figure 12C:
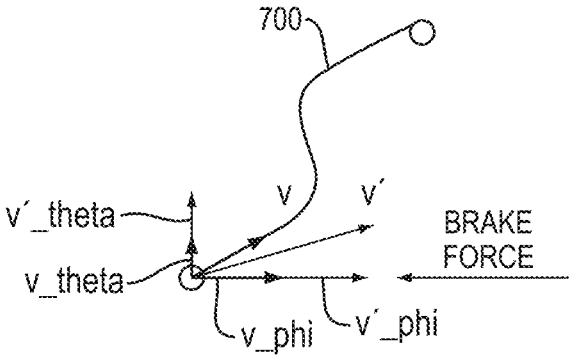
FIG. 12C is a diagram illustrating a corrective force applied for invisible hand control to maintain a user's position on a desired trajectory.

In response the detection of velocity V', a controller of the exercise device can attempt to repoint the user's velocity vector using a controller, such as a proportional-derivative controller. The controller can apply brake values based on a proportional coefficient applied to the velocity vector to partially oppose the incorrect movement. In particular, as illustrated in FIG. 12C, a brake force can be applied to directly oppose the user's V' phi movement. As resistance increases in the direction of azimuth angle $\varphi$, the user is thereby encouraged to move more heavily in the direction of the polar angle $\theta$. The brake force thus encourages the user to correct to velocity V and remain on track with trajectory 700.

Figure 12D:
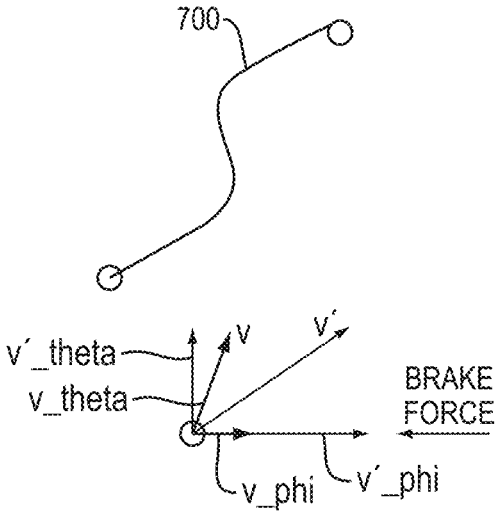
FIG. 12D is a diagram illustrating a corrective force applied for invisible hand control to reposition a user to a desired trajectory.

If the user has veered from trajectory 700, a brake force to provide position correction can be applied, as shown in FIG. 12D. In particular, a user's incorrect velocity V' can be corrected to velocity V to steer the user back to trajectory 700.

Invisible hand assistance can thus repoint the user's velocity vector by braking along the axis which has the greater velocity component, potentially slowing the user down. This responsive resistance can change dynamically depending on, not only the user's position in relation to the desired trajectory, but also the user's velocity. Invisible hand assistance can also be based on higher order metrics, such as acceleration, with a proportional coefficient applied to a component of the user's acceleration vector. The responsive resistance can mildly influence a user's trajectory, such that the user does not feel or notice the correction. Invisible hand assistance is also helpful with regard to high velocity movements, such as swinging a golf club. The application of a corrective force that directly opposes user's deviation form a trajectory, such as that shown in FIG. 11A, would be disruptive and could cause injury to the user.

If a user has veered off a desired trajectory, in addition to repointing the user's velocity vector, additional corrective forces can optionally be applied to repoint the user back towards the desired trajectory or the desired endpoint in a gentle manner. Optionally, an additional haptic cue, such as a vibration, or an audio cue can also be provided to make the user aware that he or she has deviated from the desired trajectory.

Invisible hand assistance can also be predictive. In particular, given a known position of the user interface member and a known velocity, the device can predict a user's position in the future. The device can thus detect that a user will deviate from desired trajectory and, possibly before a user has actually deviated from the trajectory, the device can adjust resistance values of the brakes accordingly.

Invisible hand assistance can also make use of information from the initial practice repetition. For example, performance data from a practice repetition of a golf swing, such as power at several points along the reference trajectory, can serve as a benchmark or baseline for the device as it dynamically adjusts resistances for subsequent repetitions of the movement. If it is known from the practice repetition that the user slows down at a particular position, the device can recognize that the user's velocity will decrease at the same or similar coordinate points for subsequent repetitions. Simply looking at a velocity vector of the user at these coordinate points may indicate that the user is potentially about to move off of the desired trajectory. However, if it is known from the benchmark data that the user is simply slowing down, corrective resistances may not be needed and the device can be programmed to avoid applying them.

In instances where subsequent repetitions of a movement have increased resistances applied for training purposes, the device can also consider that a user's trajectory may change as a result of the applied resistance. In order to maintain the correct trajectory during these subsequent repetitions, the applied resistance can be taken into account when generating corrective resistances.

While invisible hand assistance is useful for providing a user with guidance over complex, three-dimensional trajectories without the user encountering awkward, sticky resistances, invisible hand assistance can also be used in one or two plane movements in addition to, or as an alternative to, locked trajectory control. Plane movement or locked planes can be at angles to x,y,z planes of the device 10.

Collinear Resistance

Resistances can be applied by brakes of a device 10 such that, from the user's perspective, the overall resistance is constant no matter where the user is in space, which direction the user is moving in space, and/or what velocity level the user is moving in space. With collinear resistance, the force felt by the user directly opposes his or her direction of travel.

Figure 13A:
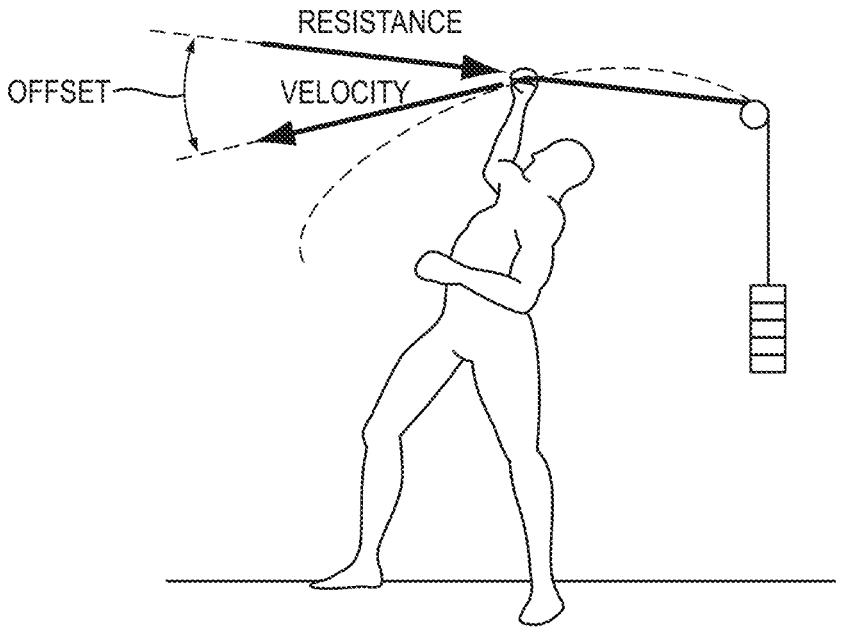
FIG. 13A is a diagram illustrating non-collinear resistance over a trajectory.

In addition to providing the sensation of fluid resistance to the user, collinear resistance also may result in increased muscle efficiency on the part of the user. As illustrated in FIG. 13A with an example of a weighted cable/pulley system, an offset occurs between a resistance opposing the path of motion and a velocity vector of a user's motion. This offset may result in reduced exertion and efficiency for the user.

Figure 13B:
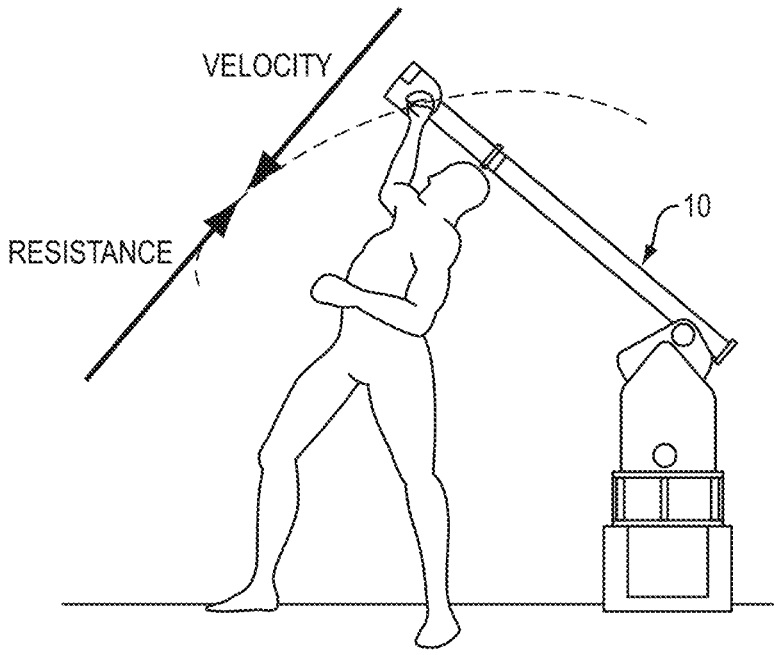
FIG. 13B is a diagram illustrating collinear resistance over the trajectory.

Collinear resistance with an example of an exercise device 10 is illustrated in FIG. 13B. As shown in FIG. 13B, the resistance directly opposes the path of motion at all points along that path, resulting in no offset between the resistance encountered by a user and a vector representing the user's velocity. The resulting feel to the user is similar to moving through fluid.

Figure 14A:
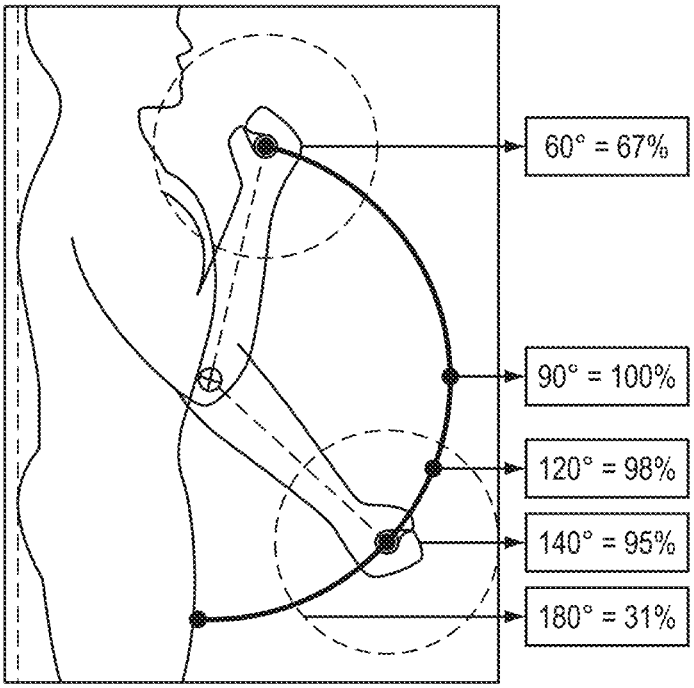
FIG. 14A is a diagram illustrating muscle exertion at various locations of a trajectory with non-collinear resistance over the trajectory.
Figure 14B:
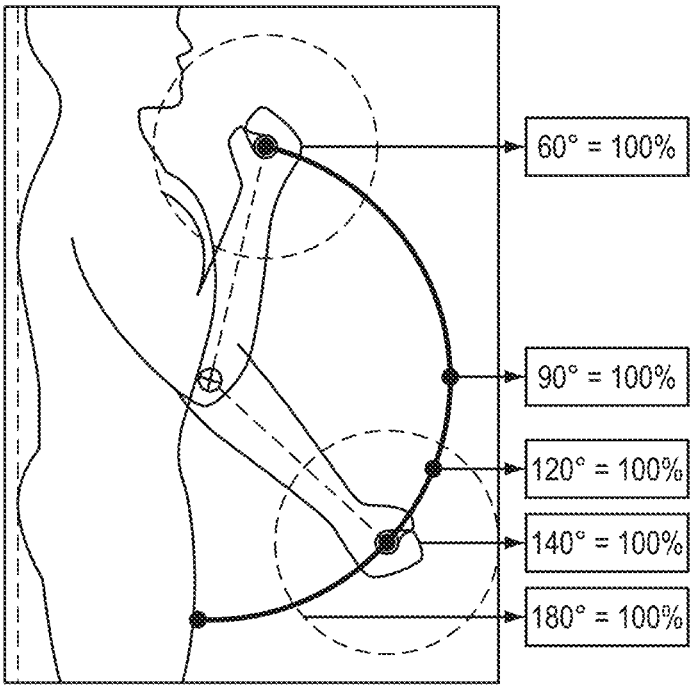
FIG. 14B is a diagram illustrating muscle exertion at locations of the trajectory with collinear resistance over the trajectory.
Figure 15A:
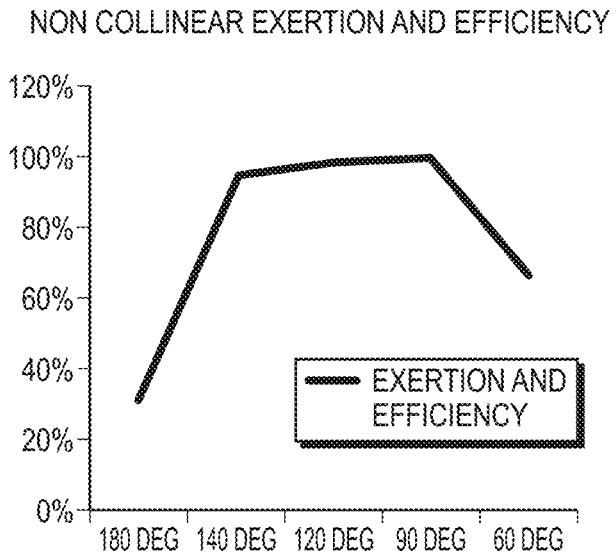
FIG. 15A is a graph of an example of muscle exertion and efficiency over a trajectory with non-collinear resistance.
Figure 15B:
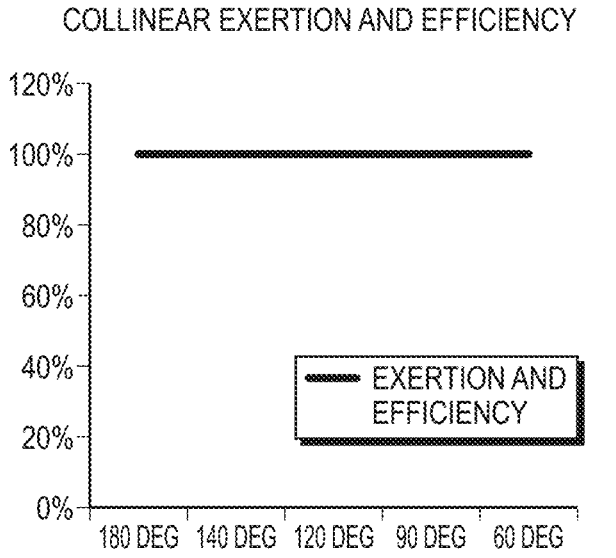
FIG. 15B is a graph of an example of muscle exertion and efficiency over the trajectory with collinear resistance.

By providing a resistance that directly opposes the user's path of motion, increased muscle efficiency may be achieved. An example of muscle efficiency at various points along a bicep curl trajectory is shown in FIGS. 14A and 14B, with FIG. 14A representing the bicep curl as performed with a dumbbell, cable, or band and FIG. 14B representing the bicep curl as performed with an exercise device that is configured to provide collinear resistance. As shown in FIG. 14A, the use of free weights or bands results in optimized muscle exertion and efficiency at only one point along the trajectory. In a dumbbell curl, this point occurs when resistance (i.e., as caused by gravity) directly opposes the path of motion, which occurs at about the halfway point of the lifting motion. In contrast, as shown in FIG. 14B, collinear resistance directly opposes the path of motion at every point along that path, resulting in optimized muscle exertion and efficiency at all points along that path. FIGS. 15A-15B show muscle exertion/efficiency versus position for the bicep curls illustrated in FIGS. 14A-14B. As shown in FIG. 15A, muscle exertion/efficiency varies over the movement depending upon the user's position, with the user exercising at less than 100% efficiency over much of the trajectory. In contrast, 100% efficiency can be achieved over the trajectory with collinear resistance, as shown in FIG. 15B. Training with collinear resistance using systems of the present invention may help users produce more fatigue-resistance muscle groups around complex joints, such as the shoulder or knee.

To provide collinear resistance along a trajectory, the components of the user's velocity vector can be determined and an appropriate brake force can be provided along each component direction. As described above, a trajectory can be defined in a spherical space such that each position $P(r,\theta,\varphi)$ along that trajectory is expressed in terms of linear distance r and angular distances $\theta$, $\varphi$ relative to the base of the exercise device or to a starting position of the user interface member (FIG. 5A). Accordingly, the user's resultant velocity V can be expressed in terms of component tangential velocities in each direction, as determined from derivatives of the positional data, according to the following:

$$V = \sqrt{V_r^2 + V_\theta^2 + V_\varphi^2} = \sqrt{\frac{dr^2}{dt} + \left(r\frac{d\theta}{dt}\right)^2 + \left(r\sin(\theta)\frac{d\varphi}{dt}\right)^2} \tag{4}$$

The component velocities in each direction ($V_r$, $V_\theta$, and $V_\varphi$) can then be divided by the overall resultant velocity (V) to obtain values for a relative proportion of movement in each direction ($V_r/V$, $V_\theta/V$, and $V_\varphi/V$). A desired resistance in each direction can then be determined by multiplying an overall desired resistance R by each proportion (e.g., $R_\theta = R\cdot(V_\theta/V)$). Appropriate resistances can then be applied to each of brakes B1, B2, and B3 to create a resistance that directly opposes the user's motion for each point along a trajectory.

Resistance Limits and Corrections

In addition to the above, corrective adjustments can also be provided to account for differing gear ratios within the device. With regard to the device 10 of FIGS. 1 and 2, different gear ratios within each stage of the device can impact fluidity of a user's motion. For example, if a resistance of the base stage is set for 10 lbs, the resistance as experienced by the user will vary depending upon the position of the linear stage. When the user interface member is pulled farther from the device and the arm 18 extends a greater distance away the base 12, more leverage is applied during the user's movement, causing the resistance from the base stage to feel like less than 10 lbs to the user. Conversely, as the linear stage is retracted closer to the device, resistance from the base stage may feel like more than 10 lbs to the user.

Accordingly, in addition to determining resistances based on relative proportions of a user's velocity, corrective terms can also be factored into the resistances set at each stage of the device. In particular and for example, the length 1 of the linear stage of the device can be multiplied by Re to create a proper torque multiplication in the shoulder stage of the device. Similarly, to create a proper torque multiplication at the waist stage of the device, a corrective term of $l \cdot \sin(\theta)$ can be multiplied by $R_{\varphi}$ and applied when waist stage resistances are being determined.

By accounting for the differing gear ratios, resistance variations that would otherwise be experienced by the user as a result of over- or under-leverage during a movement can be overcome. Additionally, a system can provide for safety limitations as a result of over- or under-leverage, depending on a user's starting position or a depth of trajectory of a movement. For example, it may be known that 18-24 inches of linear travel is required for a bicep curl. The system may be programmed to permit the user to perform a bicep curl at up to three feet away from the base of the device with up to 75 lbs of resistance, but may prohibit a user from performing a bicep curl farther than 3 feet away at the same resistance if the leverage obtained at that distance would be more than the system could safely withstand. Varying resistances can be provided depending upon distances at which an exercise is performed. For example, the device can provide resistances greater than 75 lbs with modifications to gear ratios. The system can also be programmed to provide prompts or force fields to orient a user in a particular direction with respect to the device. For example, a right-handed thrower can be instructed to face a direction perpendicular to the device with the device to their right. As the throwing motion requires mostly forward-backward movement, the user can make maximum use of the base stage of the device without overleveraging the arm.

Resistances can also be set to account for the weight of the device's arm. As the arm is pulled farther away from the device, the weight of the arm as felt by the user may increase. Resistances of the brakes can be adjusted to accommodate the added or subtracted weight of the arm, as supported by the user, during a movement.

Hysteresis of the brakes can also be considered. For example, a movement starting out at a maximum resistance (e.g., a locked state) that is to be gradually overcome by a user may actually be programmed to a value slightly below the maximum resistance. This can correct for the additional resistance due to hysteresis that would otherwise be experienced by the user at the initiation of the movement. Conversely, a movement starting with zero resistance (e.g., no activated brakes) that will gradually increase may actually have a small brake value applied at initiation of the movement.

Resistances can also be triggered for safety considerations. For example, if a user accidentally drops the arm of the device, resistances can be activated to lock the arm such that it does not hit the ground.

Simulated Resistance Types

While collinear resistance is useful for optimizing muscle exertion and efficiency during training and rehabilitation, devices of the present invention can also dynamically adjust resistances to simulate those encountered in real-life, such as gravitational resistances, fluid resistances, elastic resistances, single-directional resistances similar to what is available through a traditional or cable-based exercise apparatus, multi-directional resistances, or other resistances resembling natural or unnatural conditions. Such features can be useful when a user is, for example, completing a rehabilitation regimen and transitioning back to a sport, returning to work, or less common uses such as an astronaut performing a task in outer space.

As shown in FIG. 14A, resistance is highest during a bicep curl when the user's arm is at approximately 90°. The device can dynamically adjust resistances to simulate the increasing then decreasing resistance experienced by a user during a conventional bicep curl due to gravity. For example, based on an initial practice repetition performed by a user, a device can recognize that the movement to be performed is a bicep curl. The device can set resistances based on positional data over the reference trajectory, such that, on subsequent repetitions, as the user's positional coordinates indicate that he or she is approaching the 90° mark, resistance is increased.

Elastic resistances can also be simulated by the device. After a user establishes a reference trajectory and begins exercise, the device can detect a distance from the end space or end point of the trajectory. A scaling factor can then be applied for a spring force of $1+kx$, where k is an assigned stiffness and x is the current distance to the end point divided by the initial distance to the end point. The desired applied resistance set by the user can be multiplied by this scaling factor to simulate pushing on a spring or pulling on an exercise band, with resistance increasing or decreasing as the user approaches the end space.

Linearly Increasing Resistance

Figure 16:
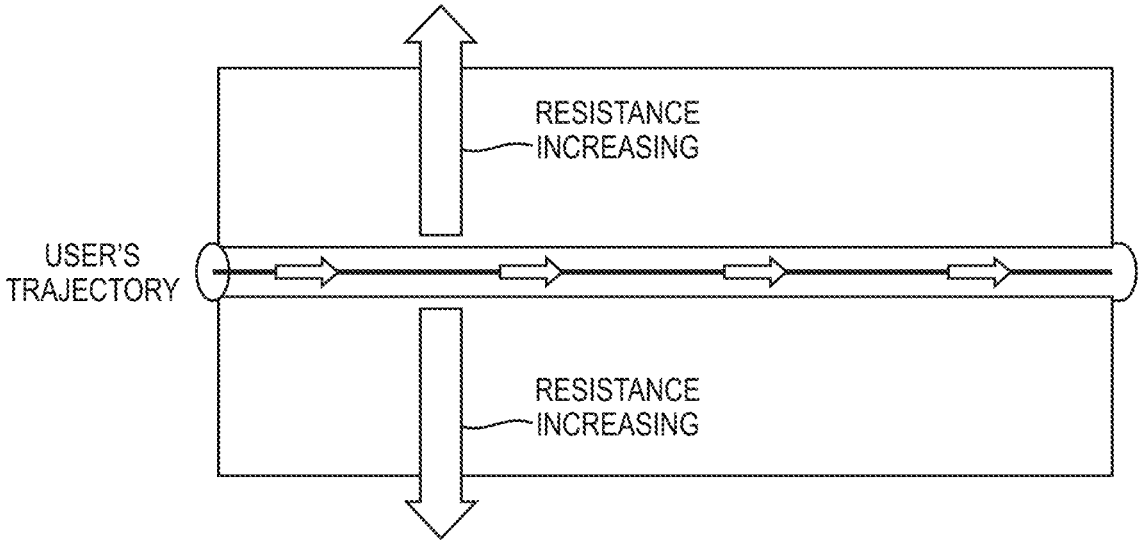
FIG. 16 is a diagram illustrating linearly increasing resistance over a trajectory.

In another embodiment, devices can provide linearly increasing or decreasing resistance around a reference trajectory, as shown, for example, by the gradient of increasing resistance illustrated in FIG. 16. In particular, the device can establish resistances that create a force field around the trajectory in which the resistances encountered by the user increase or decrease the further the user deviates from the trajectory. The force experienced by the user is dependent upon the user's position in space, rather than other higher order metrics, such as velocity and acceleration. The user experiences a sensation of gradually becoming more "stuck" and is prompted to search for the nearest, lowest resistance area.

While varying types of resistances have been described on an individual basis above, it should be understood that different types of resistances can be combined during one movement. For example, collinear resistance can be combined with invisible hand trajectory control to provide a user with a uniform resistance while also assisting the user with maintaining movement on a desired path.

Automated Physical Assessments

Exercise systems of the present invention can also be configured to perform a physical capabilities assessment of a user. A user can be prompted to perform one or more functional test motions with pre-defined, low, and/or constant resistance. The test motions can be any standard exercise motions, such as bicep curls, chest presses, external rotations, circular arm motions, etc. Alternatively, the test motion can be a complex sports motion, such as a golf swing or a throwing motion. Based on the sensed positional data during the test motions and the resistance levels, the system is able to generate assessment metrics, including power, range of motion, velocity, acceleration, endurance, explosiveness, neuromuscular control, movement quality, movement consistency, strength, three-dimensional motion in space, etc., as described above. Such information can be provided to a physical therapist, doctor, strength and conditioning specialist, or the like for use in determining a training or rehabilitation plan for the user. Alternatively, the device can compare the user's test performance metrics against established indices and recommend or automatically establish a training or rehabilitation plan for the user. Alternatively, the device can compare a user's isolated or aggregate user exercise performance metrics to another user or group of users to establish ratios between muscles and muscle groups.

By understanding a user's unique movement patterns and capabilities, resistances can be adapted within and throughout a single motion or consistently throughout a motion, and movement patterns can be influenced to optimize a user's performance. Furthermore, performance comparisons between various movements and changes in performance over time can assist with diagnosing weaknesses or injuries of a user, or, alternatively, assessing whether a user has recovered sufficiently to return to a sport. Changes in performance can be considered, for example, within the same exercise set, across defined repetitions, across subsequent or previous sessions, and/or between different exercise types of a related or non-related movement. Through specificity testing, the device can provide more detailed information for clinical decision making, such as determining when it is safe to return a patient or athlete back to their functional activities.

For example, exercise devices of the present invention can be used to capture data and obtain functional performance metrics relating to agonist and antagonist muscles. Functional performance data may be more useful in assessing various muscle-joint groups, such as the shoulder complex, than the isolated movements typically performed in isokinetic testing. Isokinetic testing and training is further described in Ellenbecker T J, Davies G. *The Application of Isokinetics in Testing and Rehabilitation of the Shoulder Complex*. J Athl Train 2000 September; 35(3); 338-350, the entire contents of which is incorporated herein by reference. Generally, the use of isokinetics in evaluation and rehabilitation of sports injuries requires the measurement of muscle force for constant velocity movements, typically for single plane movements that isolate muscles or for movements with non-collinear or single directional resistance. Constant velocity movements have little relevance to functional movements, where a user's speed changes over the course of a motion. Furthermore, most isokinetics assessments are limited to single plane movements. Information on strength and dynamic muscle performance for three-dimensional, realistic movement patterns is lacking in these assessments, which is a critical void given that even though the body is a kinetic chain, the performance of a functional movement, such as throwing, cannot be derived by summing the performance metrics of isolated muscle and movements involved in that functional movement. However, information regarding performance by agonist and antagonist muscle groups, in addition to other ratios regarding related or opposite movement patterns, can be acquired by devices of the present invention for three-dimensional, realistic movement patterns. Isokinetic testing can be used to assess muscle performance at an isokinetic fixed velocity with a single plane of movement. As real life function, activities, and sport movement involve changing angular velocities, there is a need for a device that can mimic the acceleration and deceleration changes of normal movements and in multi-planar functional movement patterns.

An initial physical assessment can also be used to calibrate an exercise device to a user. For example, a device can learn the length of a user's limbs or user's range of motion. In particular, a user can be instructed to perform a series of movements, such as a lateral arm raise and a bicep curl. Since it is known, or it is assumed, or as it has been instructed to the user, that the position of the user's foot and/or other body segments are not changing during these motions, the device can calculate limb segment lengths based on an area or volume "carved out" by each movement. The device can, for example, calculate a total length of the user's arm based on an area carved out or created by the user during an arm raise movement and can calculate a length of the user's forearm based on an area carved out or created by a bicep curl.

Similarly, a user's range of motion can be determined by the device from some exercises, such as lateral raises, proprioceptive neuromuscular facilitation (PNF) diagonal patterns, and the like. It is known that, given proper isolation of a joint, the joint will move in a nearly circular, or rotatory, manner. A system of the present invention can detect a radius of curvature of a circle corresponding to an area or volume carved out by a movement, such as a lateral raise, based on the positional data acquired from a user's movement. When combined with known limb lengths, a range of motion (i.e., an angular distance) for the user's joint can be determined.

Another advantage of performing physical assessments with a system of the present invention, which includes an exercise apparatus such as device 10, is that physical assessments can be completed in significantly less time. As described above, the system can automatically detect when a repetition has been completed, and multiple types of movement patterns can be completed by the user on one device. As a user is able to complete a series of exercises without switching machines and without requiring manual intervention, a physical assessment can be performed in significantly less time than it would otherwise take to perform isolated muscle tests using isokinetic equipment or other equipment such as elastic bands, free weights, or traditional strength equipment. Furthermore, the need for manual data entry related to patient performance, functional outcomes measurements, pre-season sport performance assessments, pre-employment screening assessments or otherwise by a physical therapist, trainer, or other supervisor is obviated or significantly reduced. Typically, manual data entry is performed with a notebook and/or documented in a computerized spreadsheet manually, which limits the amount of data that can feasibly be recorded and can include omissions or errors, such as transcription errors.

Additional data regarding a user can be provided to the device during an initial assessment, such as age, height, and weight, which can be helpful in further tailoring an exercise to a subject and comparing a user's performance to that of users in similar demographics. For example, with a known weight of the user, resistances can be calibrated for a user based on a percentage of the user's body weight. Also, with a known height of the user, a dataset of the user's maximum force for a particular movement can be compared with the datasets of others to determine if there is a correlation between height and maximum force for that movement. If a relationship is already known to exist, the user's dataset can be compared with those of others for assessment or diagnosis purposes.

Max Volitional Contraction (WC)

In one embodiment, an exercise system including a device, such as device 10, can automatically determine an ideal resistance for a user through application of a Maximum Volitional Contraction (MVC) test.

Typically, an MVC test is performed by providing a patient (or athlete) with a set resistance (e.g., a dumbbell, cable/pulley, band) and having the user perform a set number of repetitions (e.g., 10 repetitions) of an exercise (e.g., a bicep curl). A trainer or physical therapist watches the patient to gauge their effort and determine when the subject has reached maximum exertion. The trainer may also consider a "perceived exertion scale" with which a user documents his or her perceived exertion. Such an assessment is often highly subjective, both on the part of the trainer and the patient.

It is also generally recognized that a patient should train at approximately 80% of their determined MVC resistance level so as to activate fast twitch muscle fibers. For optimizing rehabilitation efforts, approximately 60% of the determined MVC resistance level is recommended to activate slow twitch muscle fibers and protect soft tissue healing structures.

Figure 27:
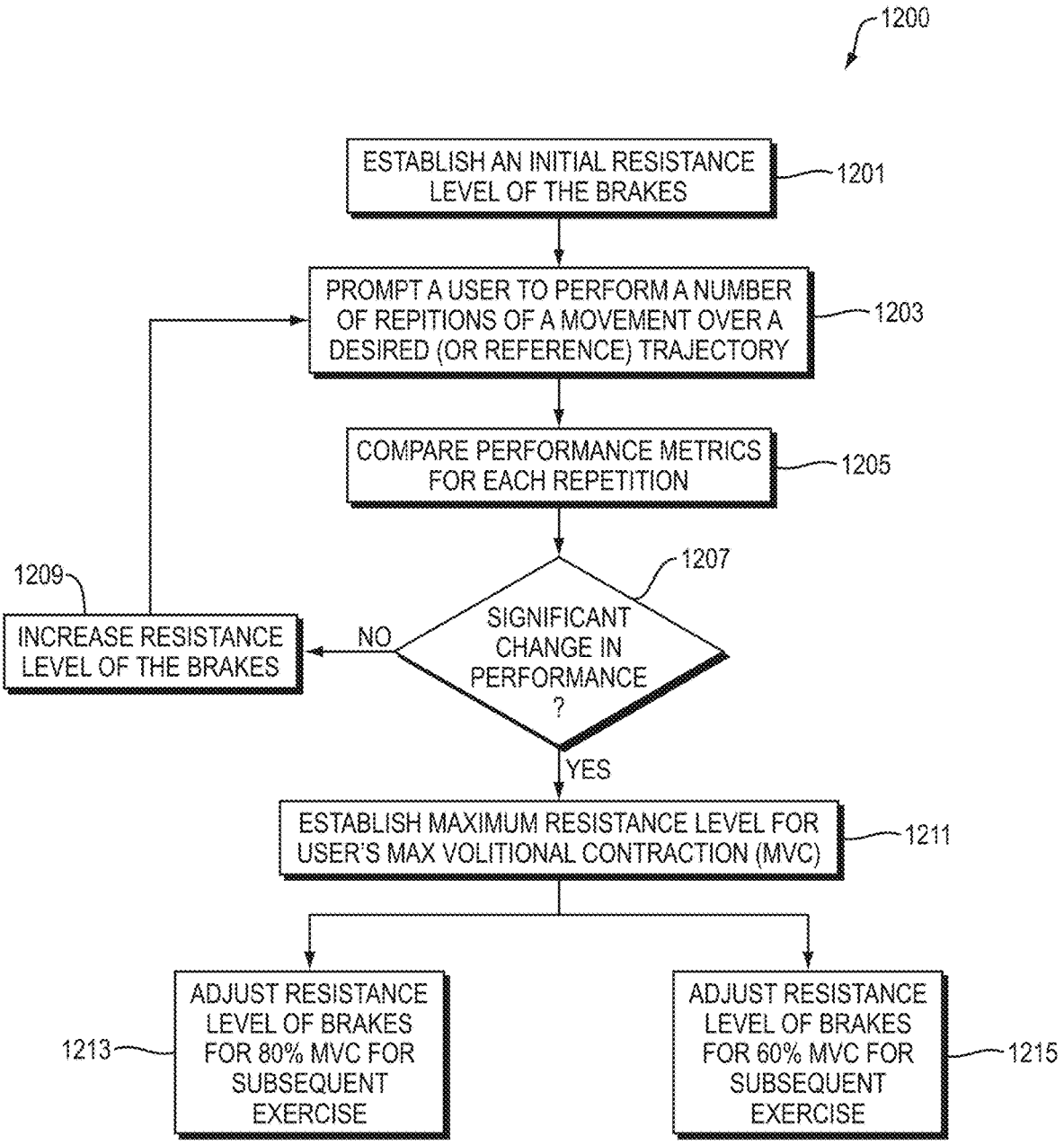
FIG. 27 is a flowchart illustrating a method of performing a physical assessment of a user.

A user's MVC can be determined more accurately using an exercise device, such as device 10, than with conventional methods using free weights or cables. An example of determining a user's MVC is shown in FIG. 27 with method 1200. A user can first be prompted to perform a desired test motion for assessment, such as a bicep curl, with no resistance, for the purposes of establishing a reference trajectory or enabling the system to detect the movement for which the MVC test is to be performed. As described above and shown in FIG. 26, sensors at each stage of the device can calculate movement along each axis of the device, with an embedded controller providing position and/or velocity data to a PC. From this positional data, the system can then establish a reference trajectory with an end space to recognize the completion of subsequent repetitions of the test motion. Before the user begins subsequent repetitions of the test motion for the MVC test, a desired resistance level can be set by the user, a trainer, or automatically by the device itself. Appropriate commands are sent to the brakes of the device to apply the selected resistance level (step 1201).

The user is then prompted to repeat the motion for a set number of repetitions (e.g., 2, 3, 4, 5, 6, 8, 10 repetitions) (step 1203). As the user repeats the motion with the device, positional data is recorded and performance metrics are calculated for each point along the trajectory of the motion, such that comparisons between the user's performance at each repetition can be performed (step 1205). The system can then detect significant changes in performance over subsequent repetitions that indicate that a user has reached peak exertion (step 1207). An indication can be any one of, for example, a significant deceleration at any point along the trajectory, a significant decrease in power as compared to average power over previous repetitions, a deviation from the desired trajectory, or any combination of the above. Among the applicable insights available through these detected changes are specific or general changes in movement patterns, for example, as occurs when a subject becomes fatigued. When a user enters a fatigued state, he or she becomes predisposed to aberrant movement patterns that may create overuse injuries.

If no abnormalities in position, movement pattern, velocity, power, or other performance metric is detected, the user can be provided with a short rest period, the system can set be set for an incrementally higher resistance level, and the user can be prompted to perform another set of repetitions (step 1209). This process can be repeated until an abnormality is detected, indicating that the user has reached his or her maximum resistance level (step 1211).

Once the resistance level for the user's MVC is determined, the system can calculate and store resistance levels of either 80% or 60% (or other pre-defined percentage) of the user's MVC for future exercise, depending upon whether the user is in training (step 1213) or rehabilitation (step 1215). The stored resistance level can be set as the user's default or standard resistance level for future training or rehabilitation sessions.

Maximum and Constant Power Control

Research has shown that maximizing power throughout a range of motion during training or exercise can optimize a user's efforts and enhance performance. However, existing exercise and training equipment does not easily enable a user to achieve constant or maximized power over a range of motion. Isokinetic equipment offers varying resistances to counter user activity with the goal of having the user maintain a constant velocity. The result of such isokinetic movements is that a user's power output fluctuates over the movement. As such, even though resistance provided by the isokinetic equipment directly opposes a user's path of motion, power output of the user is not constant and, therefore, the user's efforts are not optimized. Additionally, as described above, isokinetic equipment is limited to single plane motions.

With free weights or cables, a user performing a movement typically has fluctuating power output for at least two reasons. First, velocity changes over the range of motion. For example, when performing a bicep curl using a dumbbell, a user's velocity is initially at zero followed by periods where the user's velocity increases and decreases as the user counters gravitational resistance. Second, the resistance experienced by a user changes with the user's position in space. For example, despite a constant mass of the dumbbell, resistance over the bicep curl is provided by gravity and is highest at one point, which is at about 90° and is where the user's forearm is perpendicular to the upper arm. Accordingly, achieving a constant power output with free weights or cables is very difficult. Furthermore, performing power exercises at faster velocities using a dumbbell predisposes a user to an overuse injury because of eccentric deceleration muscle action at the end of the range of motion to slow the momentum of the weight.

There is a need for training and recovery systems that are capable of, not only providing an appropriate resistance level to the user, but adapting resistances over a trajectory, such that the user is optimizing effort, power, or other desirable metrics over the whole motion or parts of a specific motion. There is also a need to accomplish a constant or maximum power output for complex movements that require use of devices capable of providing three or more degrees of freedom for movements.

In one embodiment, an exercise system including an exercise device, such as device 10, can be configured to provide resistances such that the user is performing at a maximum power output over the desired trajectory, thereby optimizing their effort. Alternatively, the system can be configured to provide resistances such that the user is performing at a constant power output over the trajectory, even if power is not maximized.

By knowing a desired trajectory and a user's ideal average power over the trajectory, which can be determined, for example, by an MVC test as described above, an exercise device can adaptively vary brake resistances depending upon a user's position and velocity to maximize the user's power output, or to influence the user to perform at a constant power output. More specifically, an overall resistance applied by the device can be increased to slow a user's velocity at certain points along the trajectory. Conversely, overall resistance can be decreased at points where slow velocities are detected in order to increase a user's velocity.

Power expenditure on the part of the user can be calculated as force multiplied by velocity. With regard to an exercise device, such as device 10, the rotational analog for power expenditure can be expressed as torque multiplied by angular velocity, where torque is the resistance provided by the device's brakes and angular velocity is calculated at the brake shaft, as described above. As a user progresses through a repetition, velocity is determined and tracked by the system, and brake commands are provided to maintain a constant power output over the desired trajectory. The system can begin supplying resistances for constant and/or maximum power output upon detection of a low velocity, such as near the beginning of a repetition.

Diagnosis

Exercise systems of the present invention provide for the collection of performance data at several points along a desired trajectory, and users are not limited to one plane and/or constant velocity movements, as with isokinetic equipment. From the collected performance data, comparative analysis can be performed on a point by point basis along the trajectory. Typically, with conventional training and rehabilitation equipment, analysis of a user is performed by comparing whole repetitions of an exercise. As such, nuances regarding a user's performance over a movement can be missed, such as precisely where along a movement trajectory in 3D space the user achieves maximum power. In contrast, systems of the present invention provide detailed and granular data (e.g., about a 2 mm resolution over a trajectory) from which comparisons can be performed across a single repetition, multiple repetitions, multiple sessions, or multiple movement types. Systems of the present invention can provide for tens, hundreds, or thousands of data points along a trajectory, depending upon the length of the trajectory. Data resolution can be of at least about 1 mm, 2 mm, 3 mm or 5 mm.

For example, a comparison can be performed to determine where in a motion maximum power occurs for a user across several repetitions (FIG. 4B), and the value of maximum power over time can be tracked to assess progress of that metric. Such information can be helpful in diagnosing and continually assessing a user. To further the example, if peak power occurs at approximately the same point along a common trajectory for most users and peak power is occurring at a different point for a particular user, a determination as to whether the user has a particular weakness or injury can be made. Alternatively, or in addition, if a user's peak power during a movement changes over time, a comparison of the user's performance with other movements can be used to determine if the user is overloading or compensating with other muscles to perform the movement.

As part of a comprehensive diagnosis, a user performance profile can be generated for each user as the user completes a series of movements with an exercise device. The user performance profile can be based on an index of collective measurements, including measurements from isolated muscle movements, ratios between measurements of agonist and antagonist muscles, measurements of isolated joints (e.g., groups of muscles working together at, for example, the shoulder), and/or full functional movement measurements.

As each joint movement or functional movement is a result of multiple muscles working together, information about the user's performance at a high level (e.g., how well the user performs the functional movement) combined with information about the user's performance with isolated or limited muscle movements can be helpful in identifying weaknesses, susceptibility to injury, cause and effect of functional performance, and overall health. A user performance profile can include performance and quality metrics associated with each muscle involved in the kinetic chain of one or more functional movements. For example, performance profile of a user's golf swing can include performance and quality metrics pertaining to the user's legs, trunk, shoulder, upper arm, bicep, triceps, and deltoid.

Figure 28:
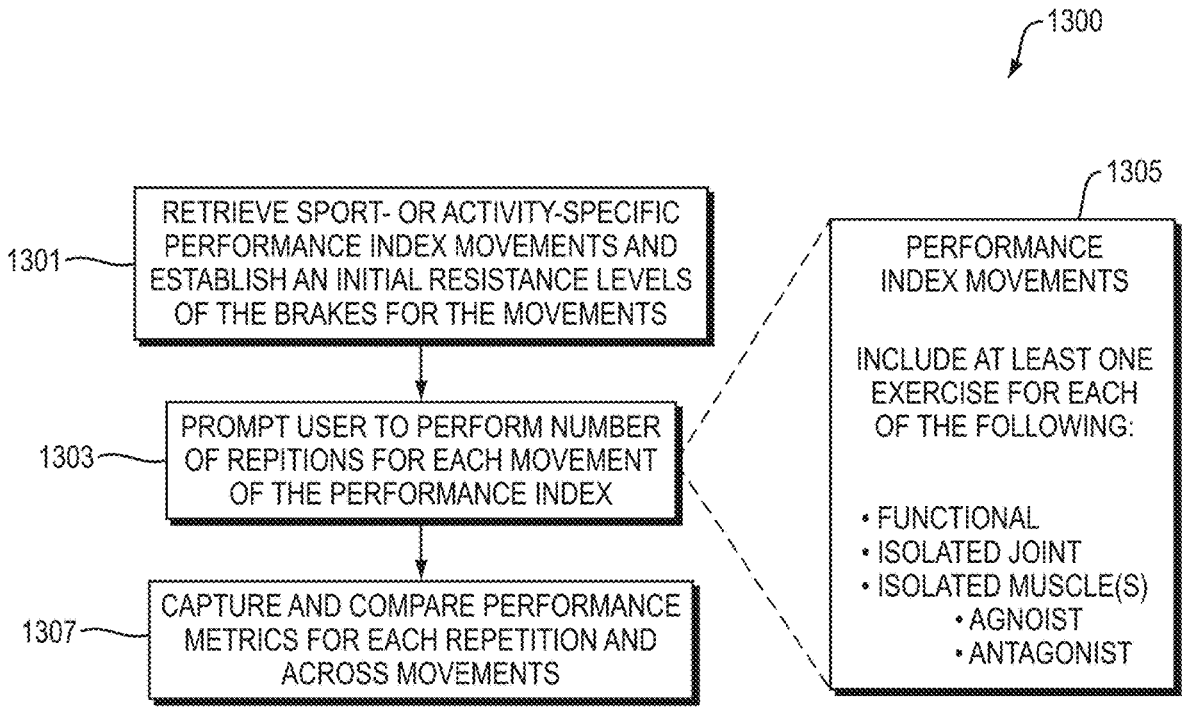
FIG. 28 is a flowchart illustrating another method of performing a physical assessment of a user.

An example of performing a physical assessment is shown in FIG. 28 with method 1300. Systems of the present invention can include performance indices that are sport or activity specific. Initial resistance levels of the brakes can be established for a series of movements, as defined by the performance index (step 1301). A user can then be prompted to perform the series of movements, thereby providing measurements specific to muscles that are relevant to the sport or activity (step 1303). Examples of performance indices are listed in Table 1.

TABLE 1

Sample Performance Indices

| | Movement | Number of Repetitions | Type |
|---|---|---|---|
| | **Golf** | | |
| 1 | Golf swing motion | 5 | Tri-planar |
| 2 | Core rotation | 5 | Transverse plane |
| 3 | Right Diagonal PNF pattern | 5 | Multi-planar |
| 4 | Left Diagonal PNF pattern | 5 | Multi-planar |
| 5 | Lower extremity movements (optional) | Variable | Variable |
| | **Throwing** | | |
| 1 | Throwing motion | 5 | Tri-planar |
| 2 | Isolated internal rotation | 5 | Transverse plane |
| 3 | Isolated external rotation | 5 | Transverse plane |
| 4 | Isolated flexion | 5 | Sagittal plane |
| 5 | Isolated abduction | 5 | Coronal/Frontal plane |
| 6 | Core rotation | 5 | Transverse plane |
| 7 | Lower extremity movements (optional) | Variable | Variable |
| | **Tennis** | | |
| 1 | Forehand swing | 5 | Tri-planar |
| 2 | Isolated internal rotation | 5 | Transverse plane |
| 3 | Isolated external rotation | 5 | Transverse plane |
| 4 | Core rotation | 5 | Transverse plane |
| 5 | Isolated horizontal abduction | 5 | Transverse plane |
| 6 | Lower extremity movements (optional) | Variable | Variable |
| | **Shoveling** | | |
| 1 | Shoveling motion | 5 | Tri-planar |
| 2 | Squat | 5 | Multi-planar |
| 3 | Core rotation | 5 | Transverse plane |
| 4 | Push | 5 | Sagittal plane |
| 5 | Left Diagonal PNF pattern | 5 | Multi-planar |
| 6 | Lower extremity movement (optional) | Variable | Variable |

In general, a performance index or performance profile for a particular motion (e.g., a tennis forearm swing) can include a number of repetitions of exercises for each of the following: isolated muscle movements for agonist and antagonist muscles (e.g., biceps and triceps), joint movements (e.g., shoulder rotation), and the functional movement itself (step 1305). Comparisons between performance metrics obtained for each movement can then be performed (step 1307).

From detailed measurements pertaining to agonist-antagonist muscles, the system can compute a ratio indicative of the user's balance between "pushing" and "pulling" muscles. Joint movement measurements can provide the system with further information about, for example, shoulder muscles as a whole. Joint movements of the shoulder can be obtained, for example, by restraining movement in the trunk and legs of the user and having the user perform an exercise involving the shoulder. Isolated muscle movements and joint movements can then be repeated for other areas of the body that are involved in the functional movement. For example, in addition to the shoulder, a user may also be performing a core rotation when swinging a tennis racket. Accordingly, movement of the user's arms and legs can be constrained, and the user can be prompted to perform movements involving the user's trunk.

Understanding each component in the kinetic chain for a particular movement provides information about a user's breaking points or compensation points. For example, instead of maintaining a normal shoulder rotation, the user may be reducing shoulder rotation and increasing trunk rotation during a throwing motion. Performance measurements obtained from the functional movement itself may indicate a point or region in the trajectory where the user is not performing properly (e.g., user's trajectory deviates from established or reference trajectory, or low velocity is identified). By performing isolated muscle and joint movements of the performance index, the reduced shoulder rotation and increased trunk rotation can be identified, either automatically by the system, or by the user or trainer reviewing the performance metrics generated by the system. The user may be weak in a muscle of the shoulder, and the weak link in the kinetic chain can thereby be identified and then targeted for monitoring and treatment in a rehabilitation or strength and conditioning program.

The system can also identify a resistance level at which the user begins compensating by over-rotating the trunk. For example, the user may be prompted to repeat one or more exercises in the performance index at increasing resistances (e.g., first 5 repetitions at 5 pounds resistance, next 5 repetitions at 10 pounds resistance, and so forth) until a deviation from trajectory is detected, or a change in biomechanics and joint angles is detected.

Measurements obtained from the system in completing a performance profile of the user provides for detailed information on the contribution of each muscle or muscle group to a particular motion. It also provides a detailed assessment of the user as a whole.

Based on the measurements obtained to generate a user's performance profile, the system can automatically, continuously, and in real time, perform comparisons of the user to the user's peer groups, to other athletes, to the general population, or to the user's own or other users' previous performance(s). Comparisons can be used to further detect deficiencies, abnormalities, or risk, and can also be used to recommend a training regimen or adjust an established training regimen to focus on areas (e.g., particular muscles or muscle groups) specifically in need of improvement.

Through a diagnostic process, the system is also able to determine if a user's functional motion is sufficient for training. For example, a user, in performing a golf swing or in completing a performance profile of a golf swing, can be shown to produce a sub-optimal swing repetition. By collecting positional data and other metrics, such as velocity and acceleration, along a trajectory of the user's swinging motion, the system can model the movement of a hypothetical golf ball. A mass and shape of the golf ball can be programmed into a modeling algorithm of the system, and the system can determine a final virtual landing position of the ball as a result of the user's swing. The system can also account for a club length and distance of the user's starting hand position from the ground. The system can provide similar assessments for other sports, such as tennis and baseball, where the user's motion is acting on another body and the reaction of the other body as a result of the user's motion is an important or relevant consideration in training.

Training Programs

Based on a user's individual performance metrics, personalized training programs can be provided that are customized around a user's goals (e.g., sports training, rehabilitation, exercise for weight loss or conditioning, etc.) as well as the user's unique physical characteristics (e.g., agonist-antagonist muscle ratio, MVC, tendency to deviate from a desired trajectory at a given positional coordinate, previously known injuries or conditions, health condition, etc.).

For example, it is known that, during one phase of a throwing motion, the subscapularis and pectoralis muscles are actively contracting. Detecting an abnormality at this phase of a throwing motion can indicate a deficiency or injury in those particular muscles of a user. The detection of deficiency in these muscles can trigger an automated exercise plan that focuses on developing the muscles in need of improvement.

Training systems can include, or obtain from a networked database, a library of exercises, sessions (e.g., series of exercises to be performed in one day), and/or regimens (e.g., series of sessions to performed over a series of days). These exercises, sessions, and/or regimens can be presented to a user through a display on or connected to the exercise device. In particular the user can be prompted through a number of repetitions, number of sets, rest time durations, and the like. Information regarding resistance type, a user's position relative to a desired trajectory, a force field, performance metrics, and so forth, can also be presented. In addition to the user, such information can also be viewable by a third party, such as a trainer or physical therapist in a physically discrete location. In some instances, it may be desirable for the trainer or physical therapist to adjust an exercise, session, and/or regimen of the user. The system can allow for such edits in real-time (e.g., a trainer adjusting a resistance level of an exercise being performed) or historically (e.g., a trainer reviewing a user's performance data from the day prior and adjusting an exercise to be performed at a later time).

With a networked environment, training systems can also be used in groups. For example, team members may be able to log into systems in remote locations at the same time, and performance data can be shared across the group or with a common trainer. Users may be able to log in through a touchscreen interface with a username and password. Alternatively, a user may be able to log in with a unique movement pattern that can be recognized by the system.

Performance data can be aggregated from several users and stored on a network such that analysis can be performed across several users. For example, the health of a population as a whole can be determined. In another example, users can be stratified based on demographics and can view comparisons of their performance to that of their peers. Peer data may be useful in, for example, detecting an injury or weakness of the user, and a training plan can be adjusted accordingly. Also, recommended exercise sessions and regimens for a given user can be further refined based on the progress or outcomes of others with similar training prescriptions. For example, machine learning algorithms can be incorporated on a cloud-based system to review stored performance data of several users. From such data, the system may determine that power increases are most efficiently achieved for most users by training at 90% of the MVC with two sets of four repetitions each, rather than at 80% of the MVC with one set of ten repetitions. The personalized training protocols of others can be automatically updated with 90% MVC resistances and revised exercise sessions.

A processer can be configured to aggregate trajectory and performance data generated by users, providing the ability to learn from individual user and aggregate user behavior. The system can thus automatically assess user performance, and the quality of a user's training, exercise, and recovery movements and overall programs without the need for direct human intervention or supervision. The system is further able to provide suggestions for correcting a user movement, providing recommendations for correcting or improving the user movement, and/or suggest or automatically generate personalized training and recovery programs to address a user's needs, such as overcoming a particular weakness.

System Architecture

A high level diagram of system components is shown in FIG. 17. A system 800 includes an exercise device, such as device 10, that provides a user 801 with three or more degrees of freedom in movement. The user 801 is able to interface with the device 10 through a user interface member (e.g., limb interface 8). Sensors 803 (e.g., encoders or sensors S1, S2, S3, S4 of FIGS. 1 and 2) for each of the stages of device 10 provide a signal to an embedded controller unit 805 indicative of the distance traveled along each axis of movement of the device. From these signals, embedded controller unit 805 obtains position counts and instantaneous encoder velocities, which are then sent to a host PC 807 for further processing. Host PC 807 may be integrated into the exercise device or may be a physically separate component in the system. Host PC 807 also controls a display and user interface 809, which can be, for example, a touchscreen.

At host PC 807, further processing is performed to determine angular distances and velocities of the base and waist stages of the device 10, as well as the linear distance and velocity of the linear stage of the device 10, as previously described. This processing can occur in a dedicated Robot Operating System (ROS) node. Host PC 807 can include additional, higher-level ROS nodes where further processing occurs, including the processing of the positional and velocity data to determine position and other metrics associated with the user interface member 8.

Host PC 807 can also determine resistances that are to be applied at each stage of the device, and transmit a signal to the embedded controller unit 805, which provides low level control to brakes 811 (e.g., brakes B1, B2, B3 of FIGS. 1 and 2). In particular, host PC 807 can translate torque values of each of the brake shafts to a controllable current level. Embedded controller unit 805 controls current to each brake to provide the proper level of torque at brakes 811 for each stage of the device 10. Factors such as the effect of temperature fluctuation on brake resistance and inherent hysteresis within each brake can be accounted for at host PC 807, such that the current provided to brakes 811 is controlled to a high degree of precision for the brakes 811 to output the proper level of torque.

Figure 19:
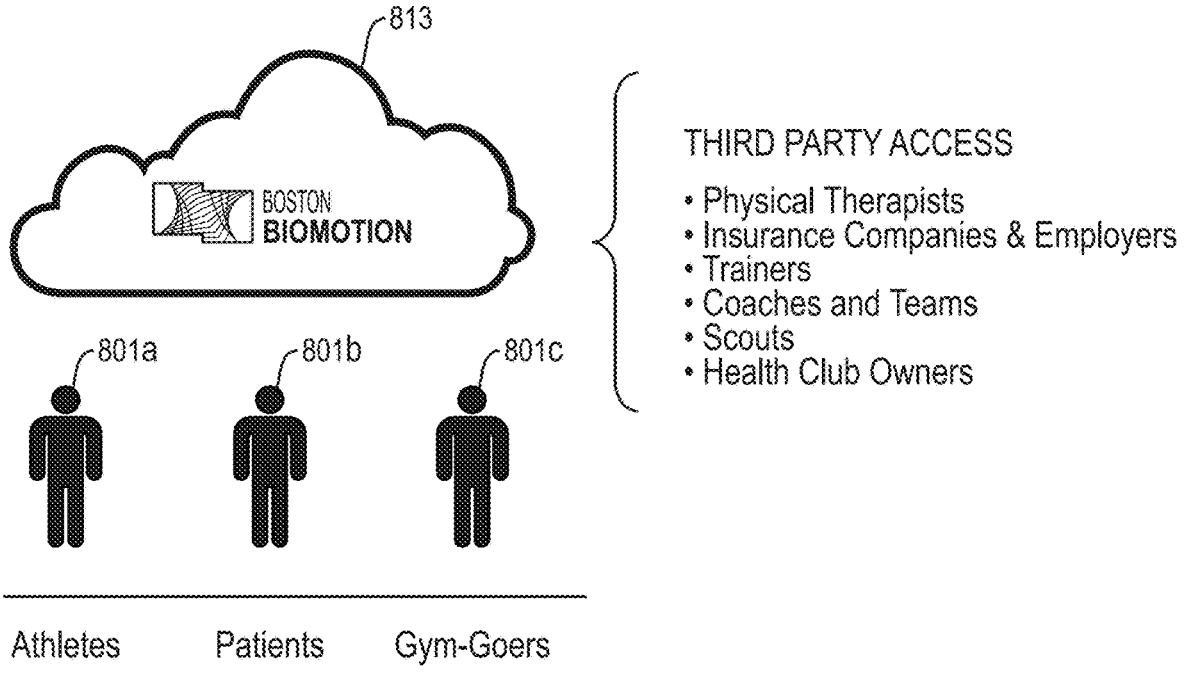
FIG. 19 is a diagram illustrating examples of third party-access.

Systems of the present invention can also be configured to interface with a networked environment, as shown in the diagrams of FIGS. 18-19 with system 800'. In particular, host PC 807 can communicate with networked server(s), or cloud 813, such that performance data of a user 801 can be centrally stored and accessed by other devices and third parties 817. For example, user 801 may be able to use any one of several devices 10 at one location, or a device 10 at a different location, by logging into the device 10 and downloading his or her historical data and training plans from the cloud 813. A third party 817 and/or a service provider 815 can view performance data of user 801 and can provide input into, for example, a training program to be implemented with host PC 807 for user 801. Cloud connectivity can enable a central data repository comprising data from several users 801*a*, 801*b*, 801*c*, enabling comparisons across several users' data.

In some embodiments, a plurality of exercise apparatuses can be connected to the network-based server. Data, such as position, velocity, acceleration, power, and other metrics of a user's performance can be aggregated and stored on the network-based server. The network-based server can also provide for central aggregation and storage of several users' data, such that data can be shared among users, users can compare their performance to that of others, and historical data pertaining to a given user can be accessed from, and used by, any networked exercise apparatus or desktop application (web page) authorized to connect within the exercise apparatus network. Multiple exercise apparatuses can be networked so that users can partake in remote fitness classes with an online instructor and user performance data can be streamed real time so users can compete against one another and take instruction from the remote trainer. Further, aggregated data from a plurality of users on one or more exercise apparatuses can be used to re-establish normative performance and recovery baselines and standards, compare an individual user or groups' performance to previously established exercise and recovery standards and norms, and a remote or local third party can view, rank, and assess individual or group user performance.

Figure 20:
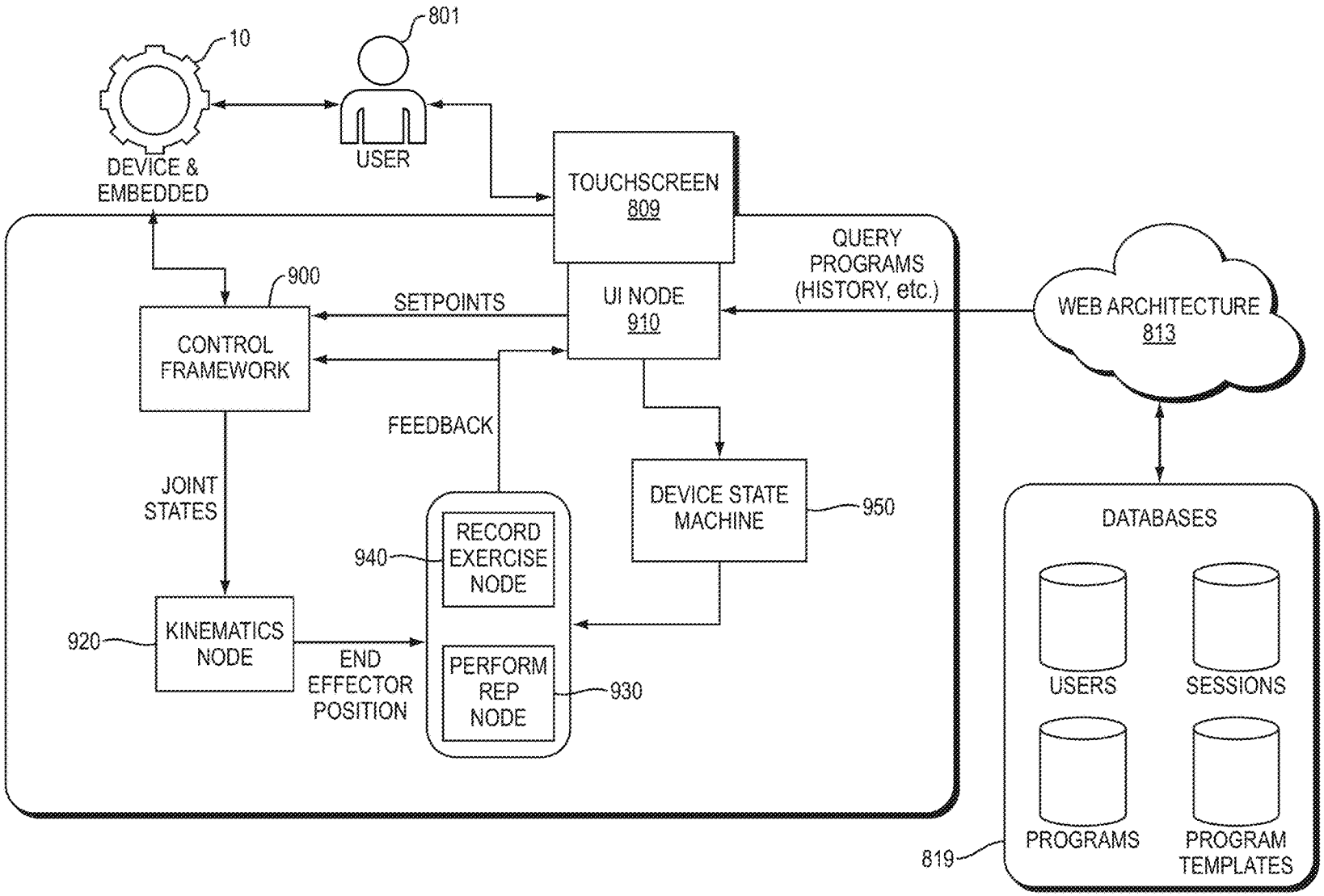
FIG. 20 is a diagram illustrating a low-level system architecture of a training system.
Figure 21:
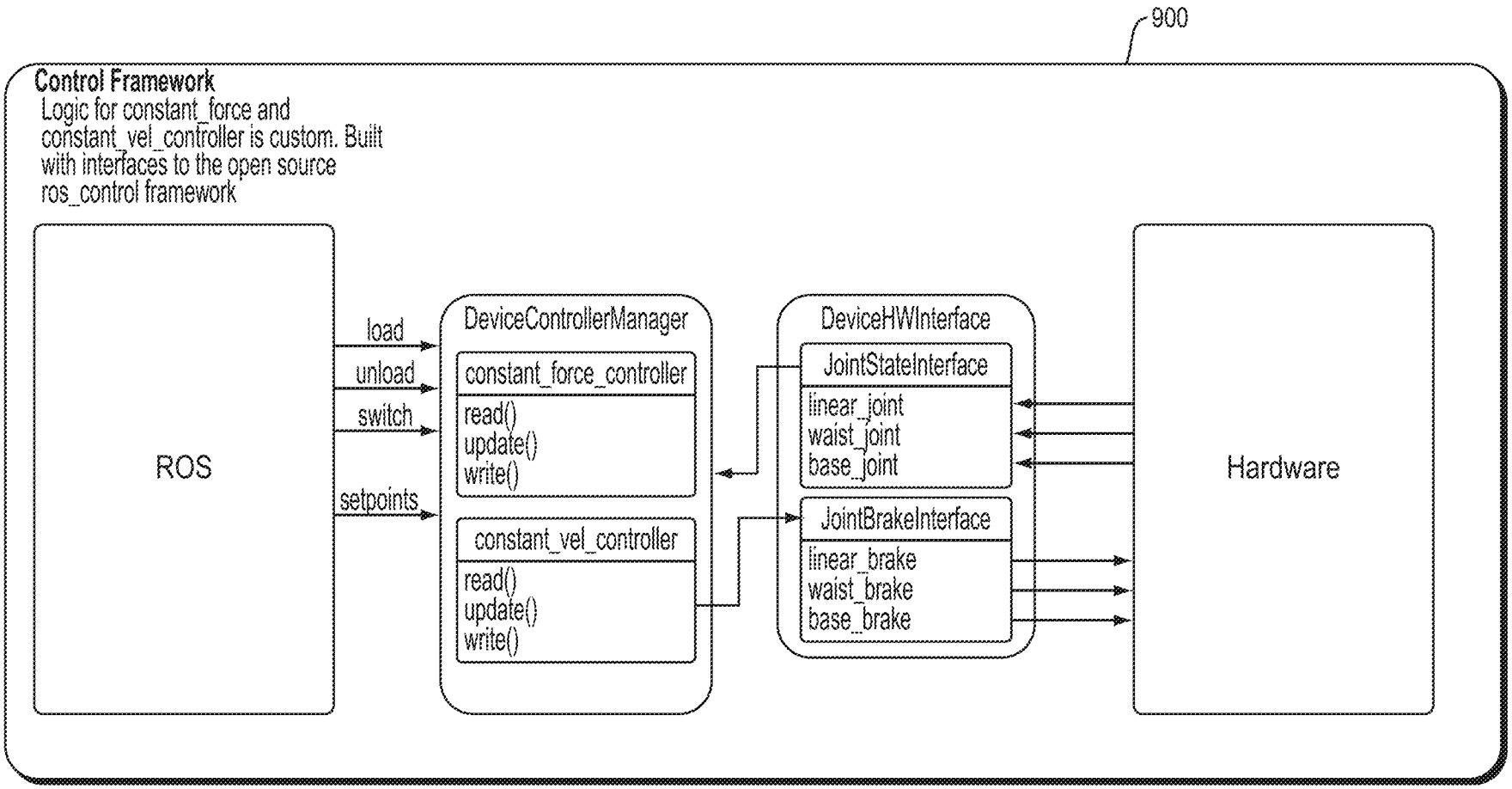
FIG. 21 is a schematic of a control framework of the system of FIG. 20.
Figure 22:
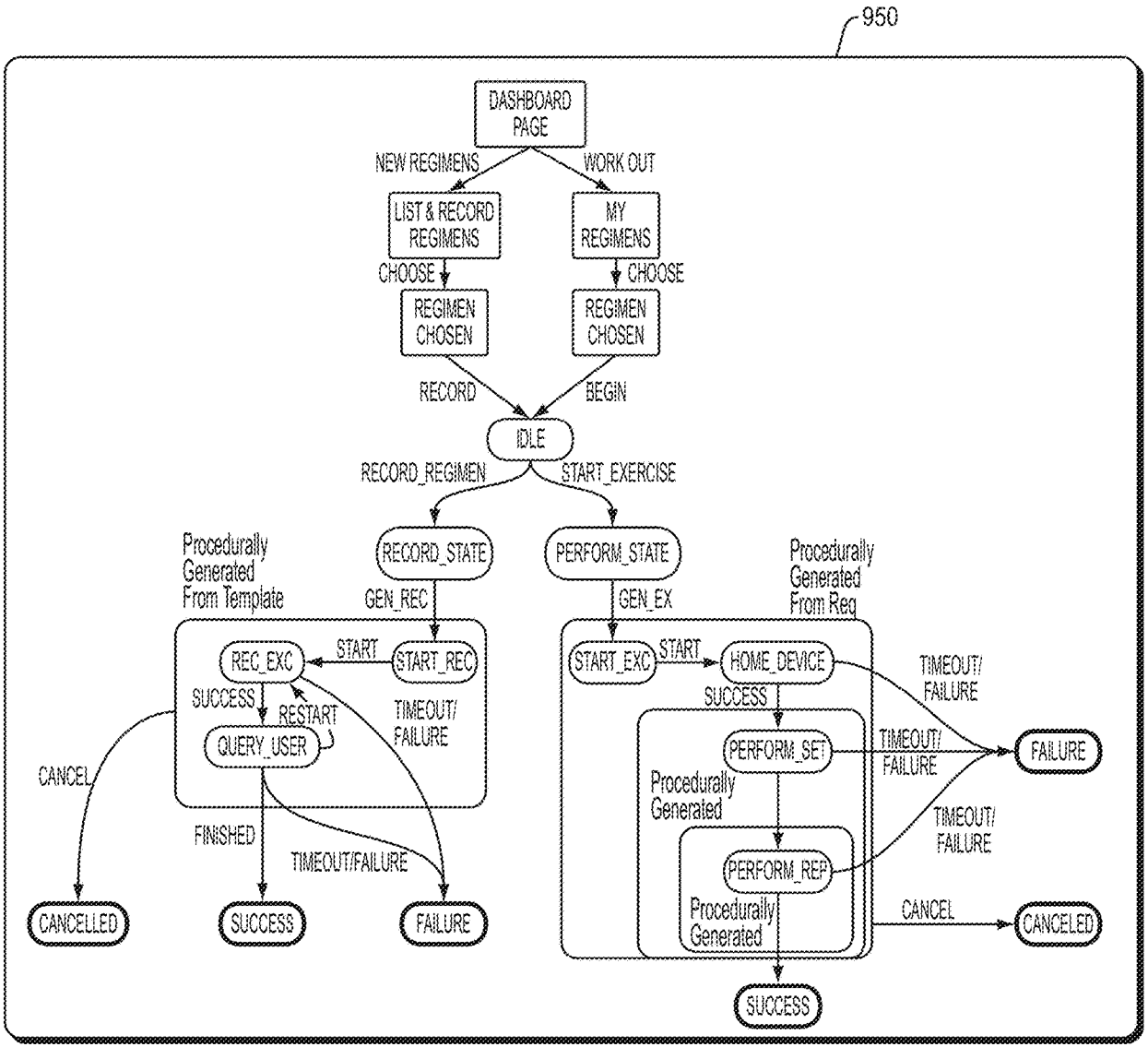
FIG. 22 is a schematic of a device state framework of the system of FIG. 20.

An example of a more detailed diagram of system components is shown in FIG. 20. In particular, host PC 807 is shown to communicate to a device 10 (including an embedded controller unit) through a control framework 900 (FIG. 21). Host PC 807 can operate on a Linux-based platform (e.g., Ubuntu). A user interface (UI) node 910 can display and receive input from a user 801 through touchscreen 809, as well as query/send information to and from network-based services, such as through cloud 813. For example, a user's historical performance data and customized training plans can be stored in databases 819 and retrieved prior to the user's next exercise or training session with device 10. The user, as well as any third parties, can also provide input on, for example, desired resistances and training programs to be performed. UI Node 910 can communicate desired set points to control framework 900, where high level commands are translated to desired brake resistances and provided to the embedded microcontroller of device 10 (FIG. 21). Control framework 900 also receives brake and joint information from the embedded microcontroller, and a separate node 920 can determine a position of the end effector (e.g., user interface member 8) in three-dimensional space. Host PC 807 also monitors the status of device 10 as being in record and perform states through device state framework 950 (FIG. 22). As the user performs a series of movements with device 10, host PC 807 calculates and records positional data and other metrics, and recognizes completion of individual repetitions, through nodes 930 and 940. Feedback is then provided to the user or third party through the UI node 910, as well as to the control framework 900.

Figures 23A, 23B:
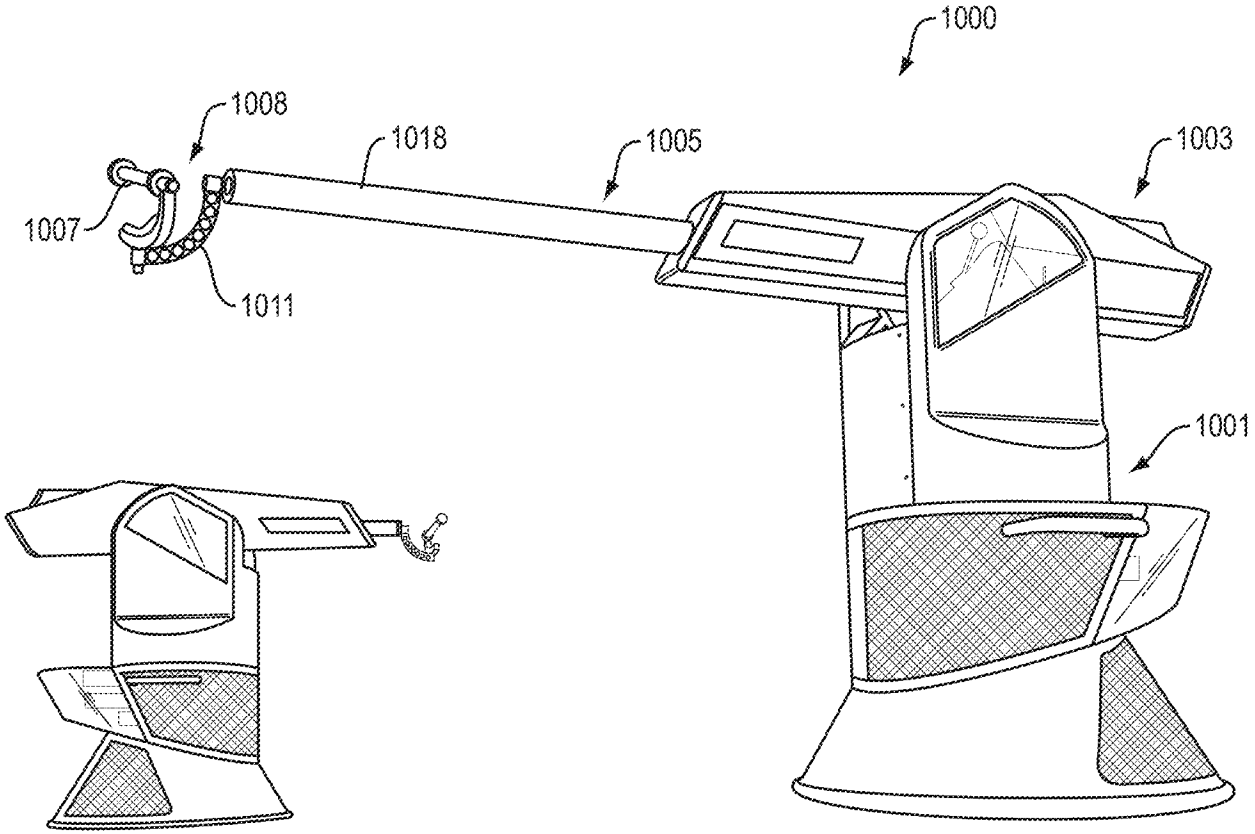
FIG. 23A is an image of an exercise apparatus in a collapsed position.
FIG. 23B is an image of the exercise apparatus of FIG. 23A in an expanded position.

While exercise systems 800, 800' have been described with respect to device 10 of FIGS. 1-2, it should be understood that other passive exercise devices providing at least two degrees of freedom of movement to a user can be used in embodiments of the present invention. For example, an exercise device 1000 is shown in FIGS. 23A-23B. Exercise device 1000 includes base stage 1001, waist stage 1003 and linear stage 1005. An arm 1018 of device 1000 is shown retracted in FIG. 23A. A user interface member 1008 can include a rotatable handle 1007. Handle 1007 can provide three degrees of freedom of movement about a joint 1009. In addition, a position of handle 1007 can be adjusted with regard to arm 1018 through repositioning on projection 1011.

Figure 24:
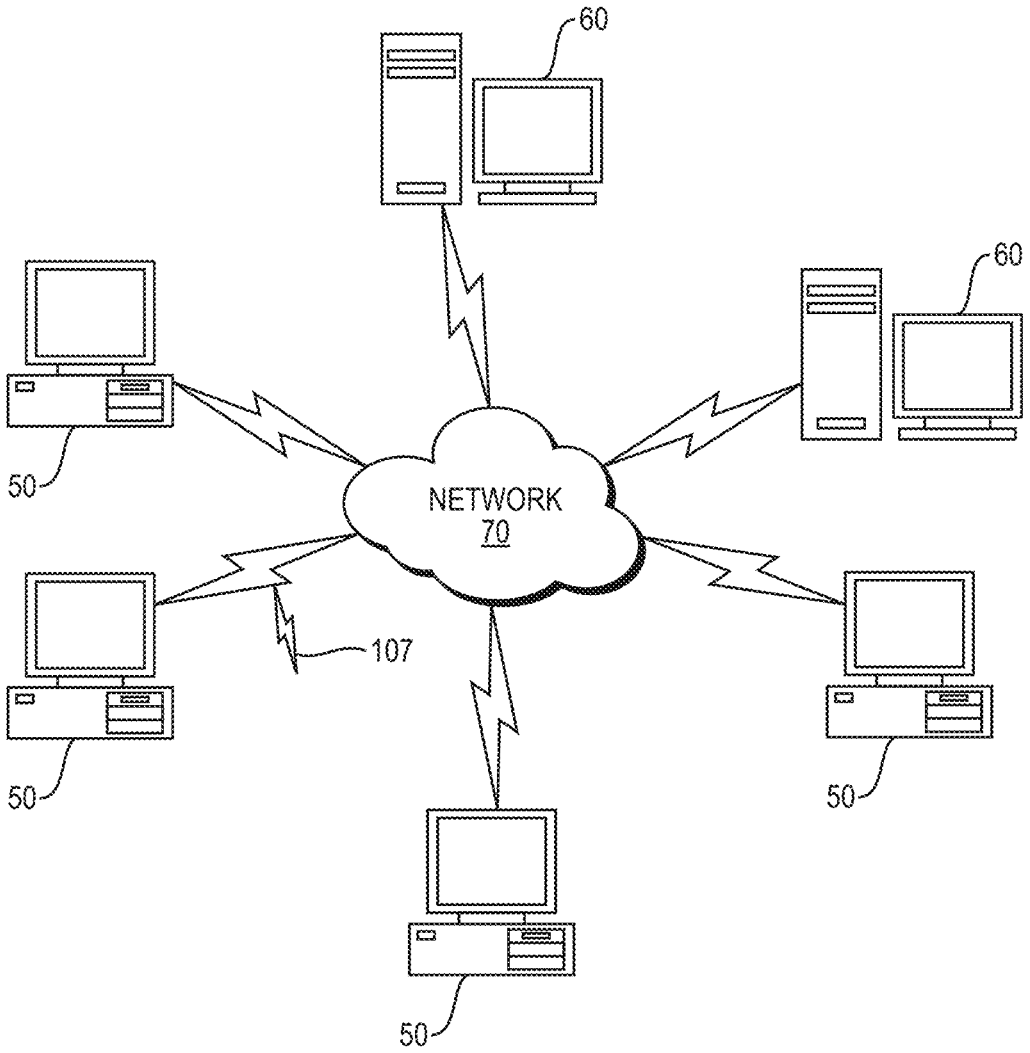
FIG. 24 is a schematic view of a computer network environment in which embodiments of the present invention may be deployed.

FIG. 24 illustrates a computer network or similar digital processing environment in which embodiments of the present invention may be implemented. Client computer(s)/devices/exercise apparatuses 50 and server computer(s) 60 provide processing, storage, and input/output devices executing application programs and the like. Client computer(s)/devices 50 can also be linked through communications network 70 to other computing devices, including other client devices/processes 50 and server computer(s) 60. Communications network 70 can be part of a remote access network, a global network (e.g., the Internet), a worldwide collection of computers, Local area or Wide area networks, and gateways that currently use respective protocols (TCP/IP, Bluetooth, etc.) to communicate with one another. Other electronic device/computer network architectures are suitable.

Figure 25:
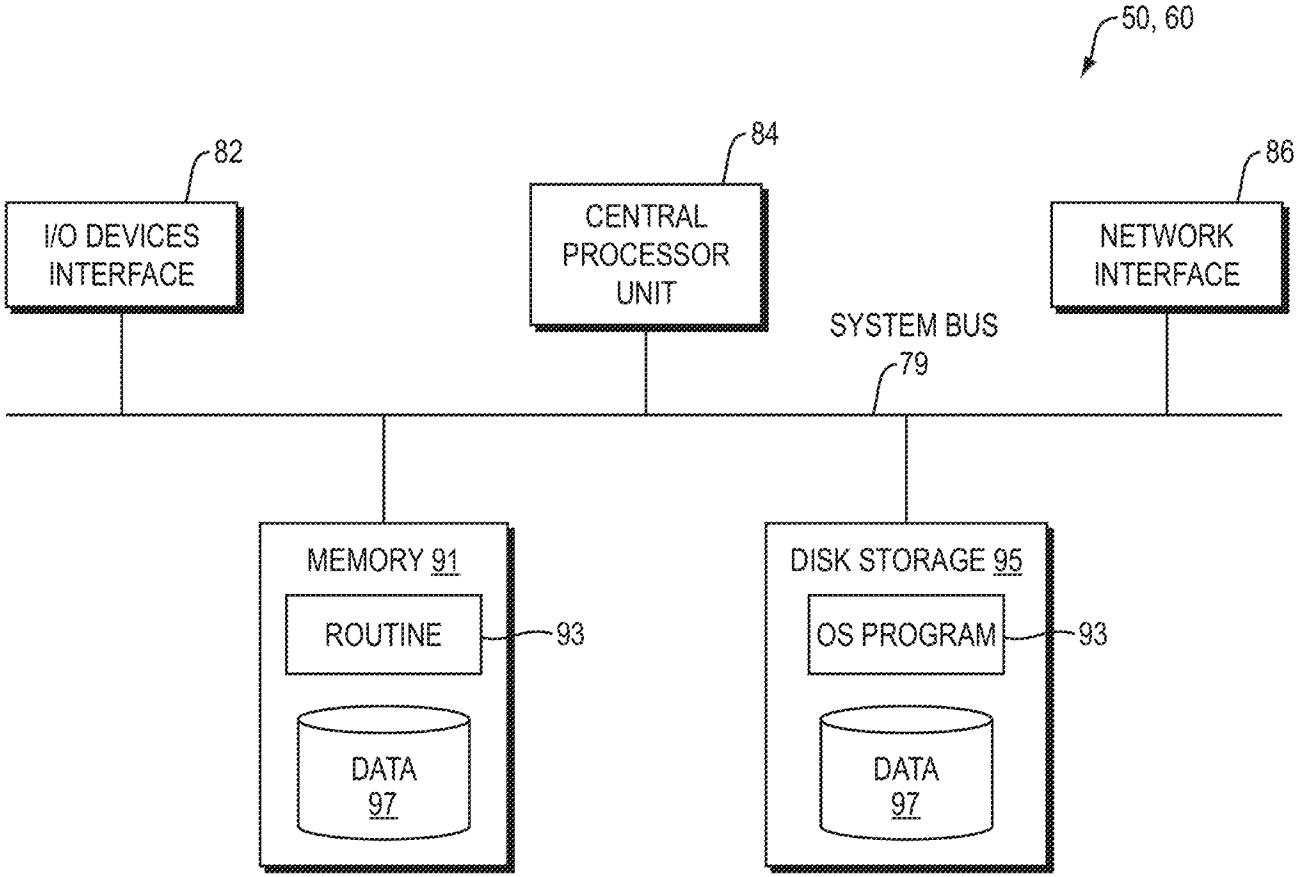
FIG. 25 is a block diagram of computer nodes or devices in the computer network of FIG. 1.

FIG. 25 is a diagram of the internal structure of a computer (e.g., client processor/device 50 or server computers 60) in the computer network of FIG. 24. Each computer 50, 60 contains system bus 79, where a bus is a set of hardware lines used for data transfer among the components of a computer or processing system. Bus 79 is essentially a shared conduit that connects different elements of a computer system (e.g., processor, disk storage, memory, input/output ports, network ports, etc.) that enables the transfer of information between the elements. Attached to system bus 79 is I/O device interface 82 for connecting various input and output devices (e.g., keyboard, mouse, displays, printers, speakers, etc.) to the computer 50, 60. Network interface 86 allows the computer to connect to various other devices attached to a network (e.g., network 70 of FIG. 2). Memory 91 provides volatile storage for computer software instructions 93 and data 95 used to implement embodiments of the present invention (e.g., calculating joint state data of a passive exercise apparatus). Disk storage 95 provides nonvolatile storage for computer software instructions 93 and data 95 used to implement an embodiment of the present invention. Central processor unit 84 is also attached to system bus 79 and provides for the execution of computer instructions.

In one embodiment, the processor routines 93 and data 95 are a computer program product (generally referenced 93), including a non-transitory computer readable medium (e.g., a removable storage medium such as one or more DVD-ROM's, CD-ROM's, diskettes, tapes, etc.) that provides at least a portion of the software instructions for the invention system. Computer program product 93 can be installed by any suitable software installation procedure, as is well known in the art. In another embodiment, at least a portion of the software instructions may also be downloaded over a cable, communication and/or wireless connection. In other embodiments, the invention programs are a computer program propagated signal product 107 embodied on a propagated signal on a propagation medium (e.g., a radio wave, an infrared wave, a laser wave, a sound wave, or an electrical wave propagated over a global network such as the Internet, or other network(s)). Such carrier medium or signals provide at least a portion of the software instructions for the present invention routines/program 93.

In alternative embodiments, the propagated signal is an analog carrier wave or digital signal carried on the propagated medium. For example, the propagated signal may be a digitized signal propagated over a global network (e.g., the Internet), a telecommunications network, or other network. In one embodiment, the propagated signal is a signal that is transmitted over the propagation medium over a period of time, such as the instructions for a software application sent in packets over a network over a period of milliseconds, seconds, minutes, or longer. In another embodiment, the computer readable medium of computer program product 93 is a propagation medium that the computer system 50 may receive and read, such as by receiving the propagation medium and identifying a propagated signal embodied in the propagation medium, as described above for computer program propagated signal product.

Generally speaking, the term "carrier medium" or transient carrier encompasses the foregoing transient signals, propagated signals, propagated medium, other mediums and the like.

Alternative embodiments can include or employ clusters of computers, parallel processors, or other forms of parallel processing, effectively leading to improved performance, for example, of generating a computational model.

The teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims.

What is claimed is:

1. A training or recovery system comprising:

an exercise apparatus including a user interface member, at least one sensor capable of sensing movement of a component of the apparatus caused by movement of the user interface member, and at least one brake capable of resisting movement of the user interface member; and a processor configured to:

receive from the at least one sensor positional data of the user interface member during movement of the user interface member over a trajectory, determine component velocities of a velocity vector representing a velocity (V) of the user interface member in a three-dimensional space based on the sensed positional data according to $$V=\sqrt{V_r^2+V_\theta^2+V_\varphi^2},$$

where each of $V_r$, $V_\theta$, and $V_\varphi$ is a determined component velocity in a component direction of the three-dimensional space, determine an opposing brake force for each component direction, the determining of the opposing brake force including apportioning a defined overall resistance (R) to each component direction according to $$R_r=R\cdot(V_r/V),$$

$$R_\theta=R\cdot(V_\theta/V),$$

$$R_\varphi=R\cdot(V_\varphi/V),$$

where each of $R_r$, $R_\theta$, and $R_\varphi$ is a determined component resistance in a component direction of the three-dimensional space, and adjust a resistance level of the at least one brake based on the determined opposing brake forces, the adjusted resistance level providing collinear resistance at the user interface member during continued movement of the user interface member over the trajectory.

2. The training or recovery system of claim 1, wherein the positional data provides a position of the user interface member in a three-dimensional space.

3. The training or recovery system of claim 1, wherein the exercise apparatus further includes a plurality of links and joints coupled to the user interface member.

4. The training or recovery system of claim 3, wherein the at least one brake includes a plurality of brakes, each of the plurality of brakes configured to apply a resistance to a link or a joint.

5. The training or recovery system of claim 1, wherein the at least one brake is a magnetic particle brake.

6. The training or recovery system of claim 1, wherein the at least one brake is a motor.

7. The training or recovery system of claim 1, wherein the sensor senses movement of the user interface member.

8. The training or recovery system of claim 1, wherein the sensor senses movement associated with a link or a joint coupled to the user interface member.

9. A method of providing training or recovery to a user comprising:

providing an exercise apparatus including a user interface member, at least one sensor capable of sensing movement of a component of the apparatus caused by movement of the user interface member, and at least one brake capable of resisting movement of the user interface member;

receiving from the at least one sensor positional data of the user interface member during movement of the user interface member over a trajectory;

determining component velocities of a velocity vector representing a velocity (V) of the user interface member in a three-dimensional space based on the sensed positional data according to $$V=\sqrt{V_r^2+V_\theta^2+V_\varphi^2},$$

where each of $V_r$, $V_\theta$, and $V_\varphi$ is a determined component velocity in a component direction of the three-dimensional space, determining an opposing brake force for each component direction, the determining of the opposing brake force including apportioning a defined overall resistance (R) to each component direction according to $$R_r=R\cdot(V_r/V),$$

$$R_\theta=R\cdot(V_\theta/V),$$

$$R_\varphi=R\cdot(V_\varphi/V),$$

where each of $R_r$, $R_\theta$, and $R_\varphi$ is a determined component resistance in a component direction of the three-dimensional space; and adjusting a resistance level of the at least one brake based on the calculated velocity or the calculated acceleration, the adjusted resistance level providing collinear resistance at the user interface member during continued movement of the user interface member over the trajectory.

10. The method of claim 9, wherein the positional data provides a position of the user interface member in a three-dimensional space.

11. The method of claim 9, wherein the exercise apparatus further includes a plurality of links and joints coupled to the user interface member.

12. The method of claim 11, wherein the at least one brake includes a plurality of brakes, each of the plurality of brakes configured to apply a resistance to a link or a joint.

13. The method of claim 9, wherein the brake is a magnetic particle brake.

14. The method of claim 9, wherein the at least one brake is a motor.

15. The method of claim 9, wherein the sensor senses movement of the user interface member.

16. The method of claim 9, wherein the sensor senses movement associated with a link or a joint coupled to the user interface member.

* * * * *